US010099876B2

(12) United States Patent
Hirota et al.

(10) Patent No.: US 10,099,876 B2
(45) Date of Patent: Oct. 16, 2018

(54) SHEET MATERIAL THICKNESS DETECTION DEVICE, SHEET MATERIAL ANOMALY DETECTION DEVICE, SHEET MATERIAL FEEDING DEVICE, AND IMAGE FORMING DEVICE

(71) Applicants: Tetsuro Hirota, Kanagawa (JP); Shingo Nishizaki, Kanagawa (JP)

(72) Inventors: Tetsuro Hirota, Kanagawa (JP); Shingo Nishizaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/379,829

(22) Filed: Dec. 15, 2016

(65) Prior Publication Data

US 2017/0174457 A1 Jun. 22, 2017

(30) Foreign Application Priority Data

Dec. 21, 2015 (JP) ..... 2015-248531

(51) Int. Cl.

*B65H 7/02* (2006.01)
*B65H 5/06* (2006.01)
*G03G 15/00* (2006.01)

(52) U.S. Cl.

CPC ..... *B65H 7/02* (2013.01); *B65H 5/06* (2013.01); *G03G 15/5062* (2013.01); *B65H 2511/13* (2013.01); *B65H 2801/12* (2013.01)

(58) Field of Classification Search

CPC ... B65H 7/02; B65H 7/12; B65H 7/06; B65H 2511/13; B65H 2511/524; B65H 2553/22; B65H 2553/24; B65H 2553/61; B65H 2553/612; B65H 5/06; G03G 15/5062

USPC ..... 271/262, 263, 265.04

See application file for complete search history.

(56) References Cited

U.S. PATENT DOCUMENTS 6,871,042 B2 * 3/2005 Nemura ..... G03G 15/5029 271/263
7,451,982 B2 * 11/2008 Kawasaki ..... G03G 15/5029 271/265.04
7,458,576 B2 * 12/2008 Kawasaki ..... B65H 7/20 271/265.04
2008/0001348 A1 * 1/2008 Kawasaki ..... B41J 11/0095 271/259

(Continued)

FOREIGN PATENT DOCUMENTS

JP 08-113387 5/1996
JP 08-119492 5/1996

(Continued)

*Primary Examiner* — David H Bollinger

(74) *Attorney, Agent, or Firm* — Harness, Dickey & Pierce, P.L.C.

(57) ABSTRACT

A sheet material thickness detection device includes a guide member, a non-rotating pressing member, a sensor, and a calculator. The guide member guides one side of a sheet material being conveyed. The pressing member presses the sheet material against the guide member in a manner displaceable in accordance with the thickness of the sheet material. The sensor is configured to magnetically or electrically detect a displaced amount of the pressing member that is displaced in accordance with the thickness of the sheet material. The calculator is configured to calculate the thickness of the sheet material based on an output signal of the sensor.

19 Claims, 23 Drawing Sheets

(56) References Cited

U.S. PATENT DOCUMENTS

| | | | |
|---|---|---|---|
| 2014/0015192 | A1 | 1/2014 | Wakabayashi et al. |
| 2015/0108714 | A1 | 4/2015 | Wakabayashi et al. |
| 2016/0264370 | A1* | 9/2016 | Okutsu ..... G03G 15/6529 |

FOREIGN PATENT DOCUMENTS

| | | |
|---|---|---|
| JP | 2005-263339 | 9/2005 |
| JP | 2014-031275 | 2/2014 |

* cited by examiner

VIEWED FROM ARROW C

SHEET MATERIAL THICKNESS DETECTION DEVICE, SHEET MATERIAL ANOMALY DETECTION DEVICE, SHEET MATERIAL FEEDING DEVICE, AND IMAGE FORMING DEVICE

CROSS-REFERENCE TO RELATED APPLICATIONS

The present application claims priority under 35 U.S.C. § 119 to Japanese Patent Application No. 2015-248531, filed Dec. 21, 2015. The contents of which are incorporated herein by reference in their entirety.

BACKGROUND OF THE INVENTION

1. Field of the Invention

The present invention relates to a sheet material thickness detection device, a sheet material anomaly detection device, a sheet material feeding device, and an image forming device.

2. Description of the Related Art

Sheet material thickness detection devices each for detecting the thickness of a sheet material such as paper in an image forming device, for example, have been conventionally known.

Japanese Unexamined Patent Application Publication No. 2014-031275, for example, discloses a reference roller and a displacement roller arranged to sandwich and convey a sheet material, and a sheet material thickness detection device that detects a difference between displaced amounts of a rotary shaft of the displacement roller in the presence and absence of the sheet material and calculates the thickness of the sheet material on the basis of the detection result.

In the sheet material thickness detection device described in Japanese Unexamined Patent Application Publication No. 2014-031275 above, however, if the device has a machining error (eccentricity or deviation from a perfect circle) that causes a change in distance between an outer periphery and the rotary shaft of the displacement roller depending on a rotation angle, the thickness of a sheet material may not be detected with high accuracy. If the displacement roller is positioned at a rotation angle at which the distance between a portion of the outer periphery of the displacement roller in contact with the sheet material and the rotary shaft is larger than a machining desired dimension, for example, the displaced amount of the rotary shaft of the displacement roller becomes large apparently. Thus, the thickness of the sheet material is calculated to be thicker than its actual thickness, failing to detect the thickness of the sheet material with high accuracy. In order to improve the detection accuracy of the thickness of a sheet material, an expensive displacement roller having less machining error is required. Thus, reduction in cost is difficult to achieve.

SUMMARY OF THE INVENTION

According to one aspect of the present invention, a sheet material thickness detection device includes a guide member, a non-rotating pressing member, a sensor, and a calculator. The guide member guides one side of a sheet material being conveyed. The pressing member presses the sheet material against the guide member in a manner displaceable in accordance with the thickness of the sheet material. The sensor is configured to magnetically or electrically detect a displaced amount of the pressing member that is displaced in accordance with the thickness of the sheet material. The calculator is configured to calculate the thickness of the sheet material based on an output signal of the sensor.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
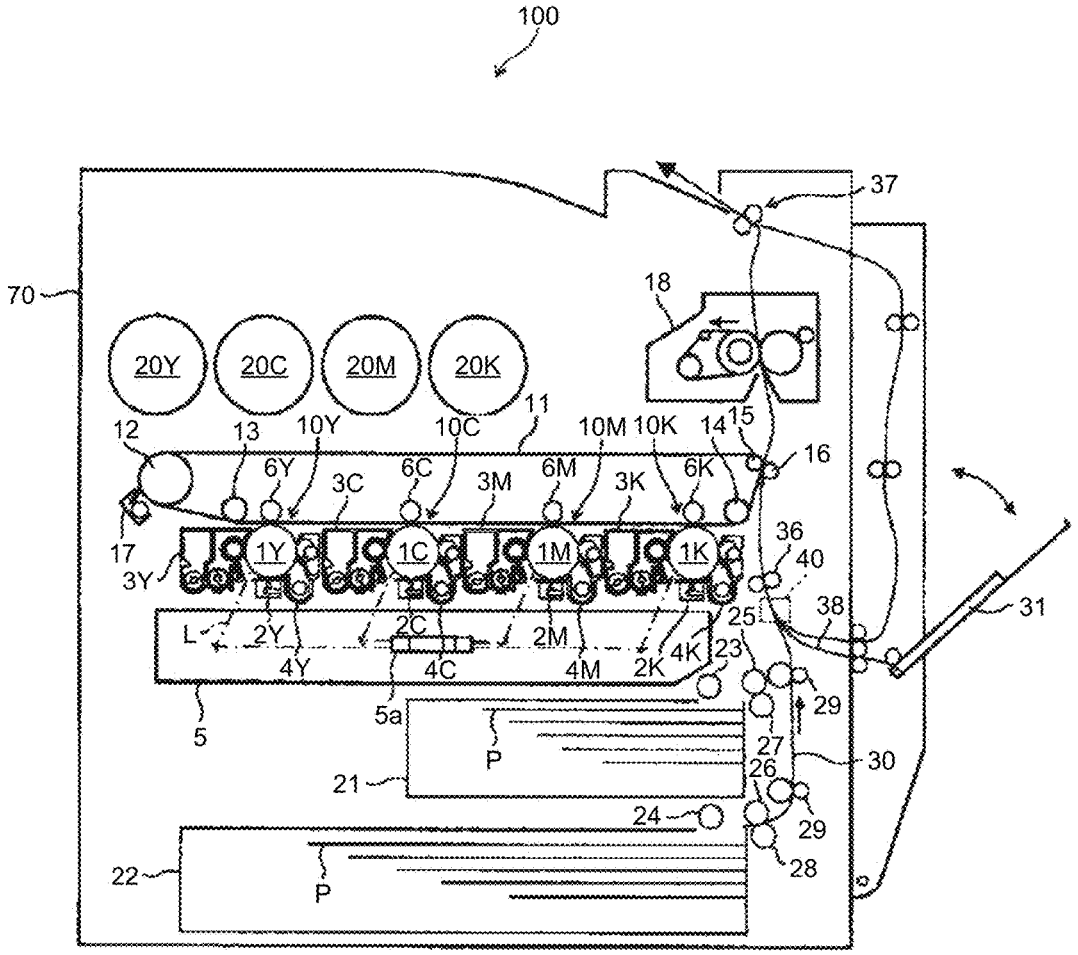
FIG. 1 is a schematic configuration diagram illustrating an example of a printer according to an embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

Figure 2:
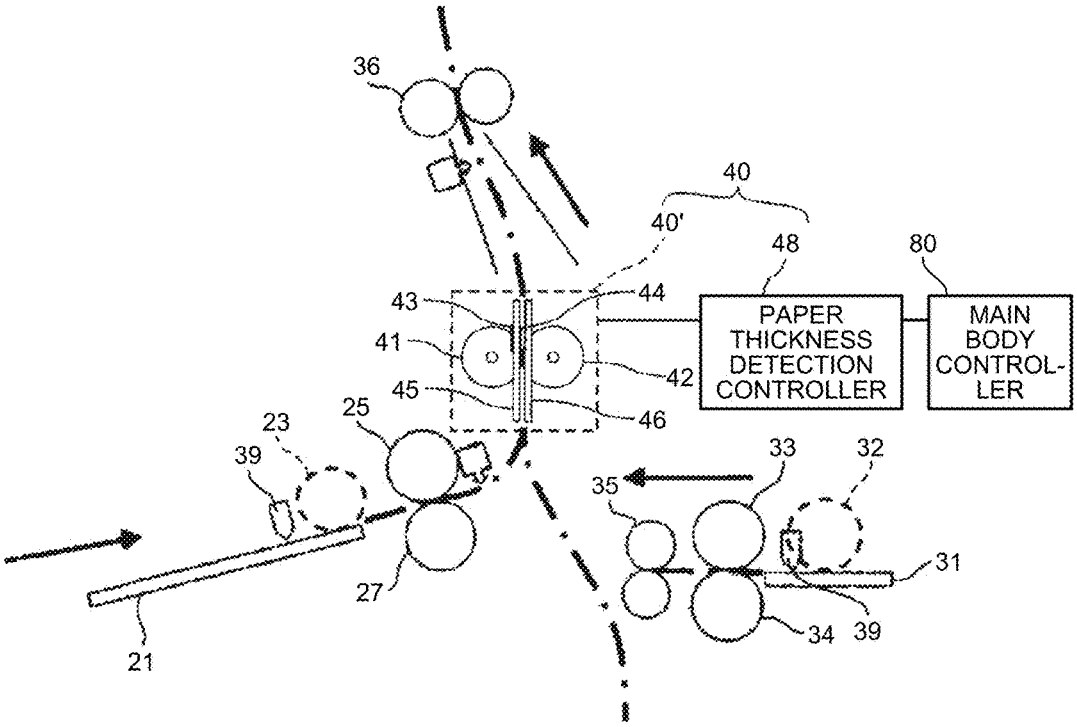
FIG. 2 is a schematic configuration diagram illustrating an example of a paper conveyance path of the printer.

FIG. 1 is a schematic configuration diagram illustrating an example of a color printer (hereinafter referred to as a "printer") 100, which is an electrophotography type image forming device according to the present embodiment. FIG. 2 is a schematic configuration diagram illustrating an example of a paper conveyance path of the printer 100. As illustrated in FIG. 1, the printer 100 according to the present embodiment includes four image forming units 10Y, 10C, 10M, and 10K that form toner images of yellow (Y), cyan (C), magenta (M), and black (K) colors, respectively.

The image forming units 10 include drum-shaped photoconductors 1Y, 1C, 1M, and 1K, respectively, and the following, for example, is arranged around each photoconductor 1. Specifically, charging devices 2Y, 2C, 2M, and 2K each for uniformly charging the surface of each photoconductor 1, developing devices 3Y, 3C, 3M, and 3K of the respective colors each for developing an electrostatic latent image on the photoconductor 1 with toners, and cleaning devices 4Y, 4C, 4M, and 4K each for removing toners remaining on the photoconductor 1, for example, are arranged.

An optical writing unit 5 for forming electrostatic latent images on the respective photoconductors 1 is provided below the image forming units 10. The optical writing unit 5 irradiates the respective photoconductors 1 with laser light L emitted by a light source via a plurality of optical lenses and mirrors while deflecting the laser light L by a polygon mirror 5*a* rotary-driven by a motor. Instead of the optical writing unit 5 having such a configuration, a unit that performs optical scanning by an LED array may be employed.

Although the image forming units 10Y, 10C, 10M, and 10K are configured as a process cartridge that can be integrally attached to and detached from a device main body 70 in the printer 100 according to the present embodiment, the use of such a process cartridge is not essential. Needless to say, the charging device 2, the developing device 3, and the cleaning device 4 may be incorporated as devices independent from the photoconductor 1. The configuration of the image forming units 10 as the process cartridge, however, is preferred from the perspective that the attachment of the above-described devices can be easily adjusted upon their repair or replacement.

The printer 100 further includes an intermediate transfer belt 11 onto which toner images formed in the image forming units 10Y, 10C, 10M, and 10K are transferred. The intermediate transfer belt 11 is wound around a plurality of rollers 12, 13, 14, and 15. Primary transfer rollers 6Y, 6C, 6M, and 6K for performing primary transfer are disposed on the inner side of the intermediate transfer belt 11 at positions adjoining to the photoconductors 1Y, 1C, 1M, and 1K, respectively. A secondary transfer roller 16 for performing secondary transfer is also disposed on the intermediate transfer belt 11 at a site opposed to the roller 15 to form a secondary transfer nip unit. The intermediate transfer belt 11 also includes a belt cleaning device 17, which is disposed at a site opposed to the roller 12, for cleaning a front surface of the intermediate transfer belt 11. A fixing device 18 for fixing toner images on paper P as a sheet material (first sheet material) is disposed above the secondary transfer roller 16.

Toner bottles 20Y, 20C, 20M, and 20K containing refill toners are provided in an upper part of the printer 100. These toner bottles 20Y, 20C, 20M, and 20K and the developing devices 3Y, 3C, 3M, and 3K are connected via refill pipes, respectively, so that the refill toners in the toner bottles 20Y, 20C, 20M, and 20K are supplied to the developing devices 3Y, 3C, 3M, and 3K, respectively, as needed. The toner bottles 20 are detachably attached to the printer main body so as to be replaced by new toner bottles when the refill toners in the toner bottles 20 run short.

Paper feeding cassettes 21 and 22 for housing the paper P as a sheet material to be fed to the image forming units 10Y, 10C, 10M, and 10K are disposed in a multistage manner below the optical writing unit 5. The paper feeding cassettes 21 and 22 can be attached to and detached from the device main body 70 and types of paper to be housed can be selected. A manual paper feeding tray 31 used for manually feeding the paper P to the image forming units 10Y, 10C, 10M, and 10K is provided on a side surface (the right side surface in the figure) of the device main body 70 in a manner capable of opening and closing in directions indicated by arrows in the figure. In addition to plain paper of an A4 or B5 size, for example, the paper feeding cassettes 21 and 22 can also house particular kinds of paper such as an envelope thicker than the plain paper and thick paper in the present embodiment. When the latter paper is used, the paper feeding cassettes 21 and 22 can be pulled out from the device main body 70 to replace their contents with such a particular kind of paper or the particular kind of paper can be inserted from the manual paper feeding tray 31.

As illustrated in FIGS. 1 and 2, the paper feeding cassettes 21 and 22 are provided with pickup rollers 23 and 24, respectively, that can each rotate in a conveyance direction while being in contact with the top sheet among the sheets of paper P in the cassette and that can come into and out of contact with the paper. Feed rollers 25 and 26 for conveying the paper P brought up by the pickup rollers 23 and 24 are provided downstream of the pickup rollers 23 and 24 in the conveyance direction. Also, separate rollers 27 and 28 capable of rotating in a direction opposite to that of the feed rollers 25 and 26 via torque limiters are provided so as to be opposed to and in contact with the feed rollers 25 and 26. A paper feeding path 30 provided with a plurality of conveyance roller pairs 29 for sandwiching and conveying the paper P is formed downstream of the feed rollers 25 and 26 in the conveyance direction.

The paper feeding cassettes 21 and 22 are each equipped with sensors as will be described below, including photosensors, for example. Examples of such sensors may include a paper end sensor 39 for detecting a remaining amount or the presence or absence of the paper P housed in the paper feeding cassette, a size detection sensor for detecting the size and orientation of the paper, and a tray setting sensor for detecting whether each of the paper feeding cassettes 21 and 22 has been set to the printer main body. The paper feeding path 30 is also provided with a paper conveyance sensor for detecting whether the paper P is being conveyed suitably or the presence or absence of the occurrence of conveyance jam (paper jam), for example.

As with the paper feeding cassettes 21 and 22, the manual paper feeding tray 31 is provided with a pickup roller 32 for manual paper feeding that can rotate in the conveyance direction while being in contact with the top sheet among the sheets of paper P and that can come into and out of contact with paper. A feed roller 33 for manual paper feeding that conveys the paper P brought up by the pickup roller 32 for manual paper feeding is provided downstream of the pickup roller 32 for manual paper feeding in the conveyance direction. Also, a separate roller 34 for manual paper feeding that can rotate in a direction opposite to that of the feed roller 33 for manual paper feeding via a torque limiter is provided so as to be opposed to and in contact with the feed roller 33 for manual paper feeding. A pair of conveyance rollers 35 for manual paper feeding is provided in a paper feeding path 38 for manual paper feeding downstream of the feed roller 33 for manual paper feeding in the conveyance direction so that the paper feeding path 38 for manual paper feeding joins the above-described paper feeding path 30.

A pair of registration rollers 36 is disposed at an end of the paper feeding path 30 (the paper feeding path 38 for manual paper feeding). Once the pair of registration rollers 36 sandwiches the paper P sent from the plurality of conveyance roller pairs 29 therebetween, the pair of registration rollers 36 temporarily stops the rotation thereof. The pair of registration rollers 36 then sends out the paper P toward the secondary transfer nip at appropriate timing.

In the present embodiment, the mechanism for feeding paper from the paper feeding cassettes 21 and 22, the mechanism for feeding paper from the manual paper feeding tray 31, and a paper thickness detection device 40 as a sheet material thickness detection device to be described later, for example, constitute a paper feeding device for feeding the paper P on which images are to be formed. The paper feeding device functions as a sheet material feeding device, which is a first sheet feeder.

An image forming operation in the printer 100 with the above-described configuration will be described next.

First, the paper P sent into the paper feeding path 30 from the paper feeding cassette 21 or 22 or the manual paper feeding tray 31 by the pickup roller 23, 24, or 32 is conveyed through the paper feeding path 30 from the lower side toward the upper side in the figure while being sandwiched between the rollers of the conveyance roller pairs 29. The paper P having reached the pair of registration rollers 36 temporarily stops in a standby state to wait for synchronized timing for image formation. Electrostatic latent images are formed on the photoconductors 1Y, 1C, 1M, and 1K uniformly charged by the charging devices 2Y, 2C, 2M, and 2K by means of exposure scanning with laser light by the optical writing unit 5. The toners are supplied to the electrostatic latent images by the developing devices 3Y, 3C, 3M, and 3K of the respective colors to form yellow, cyan, magenta, and black toner images on the surfaces of the photoconductors 1Y, 1C, 1M, and 1K, respectively.

Next, voltage is applied to the primary transfer rollers 6Y, 6C, 6M, and 6K, thus causing the toner images on the photoconductors 1Y, 1C, 1M, and 1K to be transferred sequentially onto the intermediate transfer belt 11. At this time, the image forming operations of the respective colors are performed at different timing from the upstream side toward the downstream side so that the toner images are transferred in an overlapping manner at the same position on the intermediate transfer belt 11. The images formed on the intermediate transfer belt 11 are conveyed to the position of the secondary transfer roller 16 (secondary transfer nip). In synchronization with this timing, the paper P on standby in the pair of registration rollers 36 is sent to the position of the secondary transfer roller 16 and the toner images are then transferred onto the paper P. Thereafter, the paper P on which the toner images have been transferred is conveyed to the fixing device 18 for heat fixing. The paper P having undergone the fixing is ejected to the outside of the device through paper ejection rollers 37.

In the printer 100 having the above-described configuration, the paper thickness detection device 40 is provided as indicated by a dotted line in FIG. 1 at a position downstream of the joining point between the paper feeding path 30 and the paper feeding path 38 for manual paper feeding in the paper conveyance direction and upstream of the pair of registration rollers 36 in the paper conveyance direction. The paper thickness detection device 40 is a sheet material thickness detection device for detecting, with a magnetic permeability sensor, a thickness of the paper P as a sheet material before image formation.

As illustrated in FIG. 2, the paper thickness detection device 40 includes a paper thickness detection device main body 40' provided in the conveyance path of the paper P and a paper thickness detection controller 48 for controlling the paper thickness detection device main body 40' and processing a signal from the magnetic permeability sensor. The paper thickness detection controller 48 includes, for example, a CPU, a storage device (memory), and an I/O interface unit. A predetermined control program is loaded into and run on the paper thickness detection controller 48 to execute various types of control and various types of data processing such as the calculation of a paper thickness. The configuration of the paper thickness detection device main body 40' will be described later.

The printer 100 of the present embodiment includes a main body controller 80, which is a controller for controlling conditions for an image formation process on the basis of a detection value detected by the paper thickness detection device 40, in the device main body 70. The main body controller 80 includes, for example, a CPU, a storage device (memory), and an I/O interface unit. A predetermined control program is loaded into and run on the main body controller 80 to execute various types of control and data processing.

A paper thickness detection device 140 for detecting a thickness of paper by using a conventional rotating detection roller according to a comparative example will now be described.

Figure 19A:
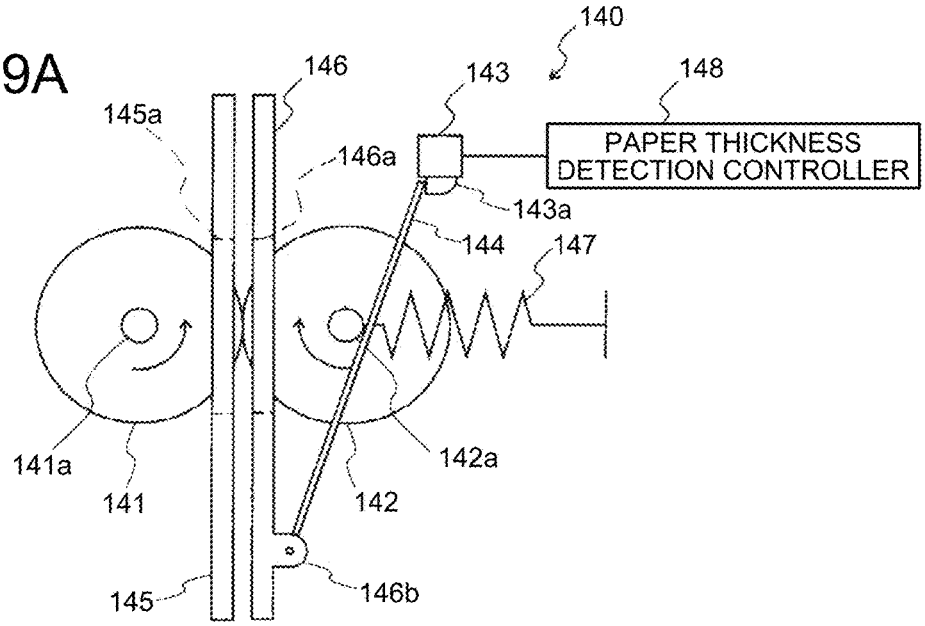
FIG. 19A is a side view illustrating an exemplary configuration of a paper thickness detection device according to a comparative example.
Figure 19B:
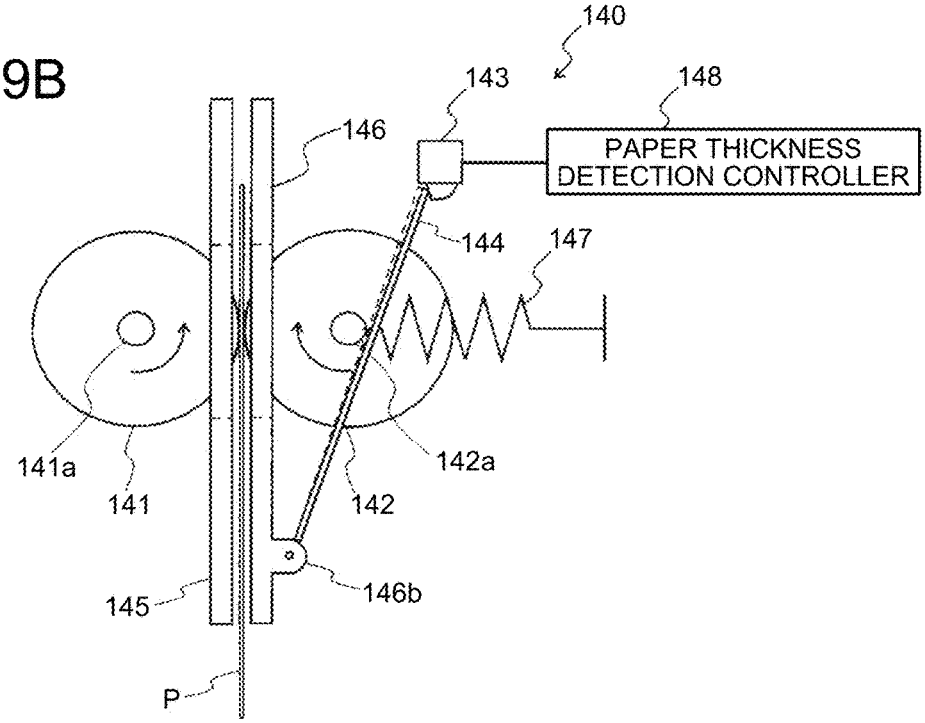
FIG. 19B is a side view illustrating a state in which the paper thickness detection device is detecting a paper thickness.

FIG. 19A is a side view illustrating an exemplary configuration of the paper thickness detection device 140 according to the comparative example. FIG. 19B is a side view illustrating a state in which the paper thickness detection device 140 is detecting a paper thickness. The paper thickness detection device 140 includes, for example, a driving roller 141, a driven roller 142 serving as a detection roller, an encoder 143, a paper thickness detection lever 144, and a driving roller-side conveyance guide plate 145. The paper thickness detection device 140 further includes, for example, a driven roller-side conveyance guide plate 146, a coil spring 147, and a paper thickness detection controller 148.

The driving roller 141 is supported by a driving roller shaft 141*a* rotary-driven by a drive source such as a motor. The driven roller 142 is arranged so as to be opposed to the driving roller 141 and rotatably supported by a driven roller shaft 142*a* biased toward the driving roller 141 by the coil spring 147. The driven roller 142 is supported by the driven roller shaft 142*a* so as to be displaceable in the horizontal direction in the figure in conformity with the paper thickness.

The driving roller-side conveyance guide plate 145 and the driven roller-side conveyance guide plate 146 are provided with openings 145*a* and 146*a*, respectively. The driving roller 141 and the driven roller 142 are in contact with each other via these openings 145*a* and 146*a* to form a conveyance nip.

The paper thickness detection lever 144 is swingably supported by a lever support 146*b* of the driven roller-side conveyance guide plate 146. The paper thickness detection lever 144 slidably comes into contact with the driven roller shaft 142*a* at an intermediate portion in the longitudinal direction thereof so as to move in conformity with the driven roller shaft 142*a*. The thus configured paper thickness detection lever 144 swings in conformity with the displacement of the driven roller shaft 142*a*, and a tip thereof thereby moves and displaces a displacement detection unit 143*a* of the encoder 143.

In the paper thickness detection device 140, the paper P conveyed between the driving roller-side conveyance guide plate 145 and the driven roller-side conveyance guide plate 146 proceeds into the conveyance nip between the driving roller 141 and the driven roller 142 as illustrated in FIG. 19B. The driven roller 142 and the driven roller shaft 142*a* are thereby displaced to the right in the figure by an amount corresponding to the thickness of the paper P. Along with the displacement of the driven roller shaft 142*a*, the paper thickness detection lever 144 swings and the tip thereof thereby moves and displaces the displacement detection unit 143*a* of the encoder 143. The encoder 143 then outputs a detection signal corresponding to the displaced amount of the displacement detection unit 143*a* to the paper thickness detection controller 148. The paper thickness detection controller 148 having received this detection signal calculates the thickness of the paper P derived from a difference from a detection signal when the conveyance nip has no paper P.

According to the paper thickness detection device 140 with the conventional configuration, however, the displaced amount of the driven roller shaft 142*a* also contains the swing of the driven roller shaft 142*a* and a rotational fluctuation component resulting from the rotational period of the driven roller 142 since the encoder 143 detects the displaced amount via the paper thickness detection lever 144. Thus, the displaced amount corresponding to the paper thickness cannot be detected with high accuracy. Moreover, in order to average errors in the radial direction of the driven roller 142, detection for one roll or more in the presence of paper and detection for one roll or more in the absence of paper need to be performed. Thus, an interval between two sheets of paper needs to have a distance corresponding to at least one roll or more.

In view of the above circumstances, the paper thickness detection device 40 according to the present embodiment is configured to directly detect, with a magnetic permeability sensor, a displaced amount of a paper pressing plate, which serves as a non-rotating pressing member that is displaced by a thickness of the paper P, magnetically and in a contactless manner.

Figure 3A:
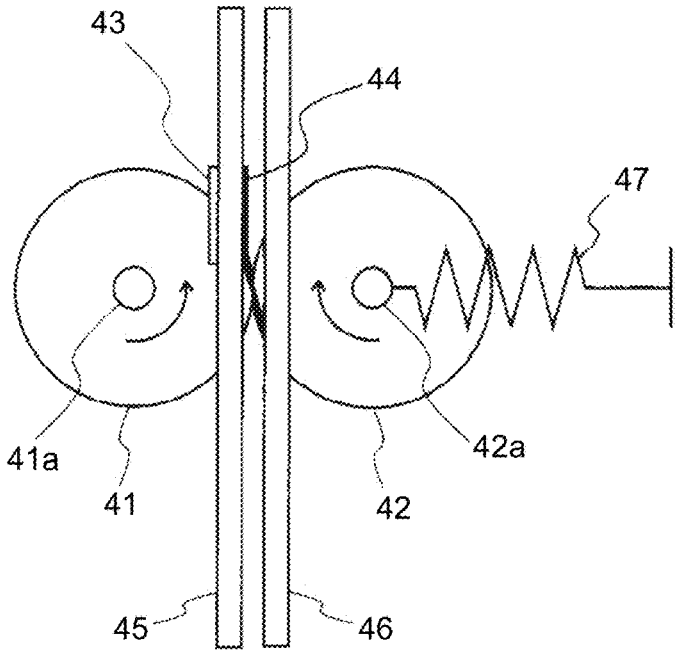
FIG. 3A is a side view illustrating an exemplary configuration of a paper thickness detection device main body included in the printer.
Figure 3B:
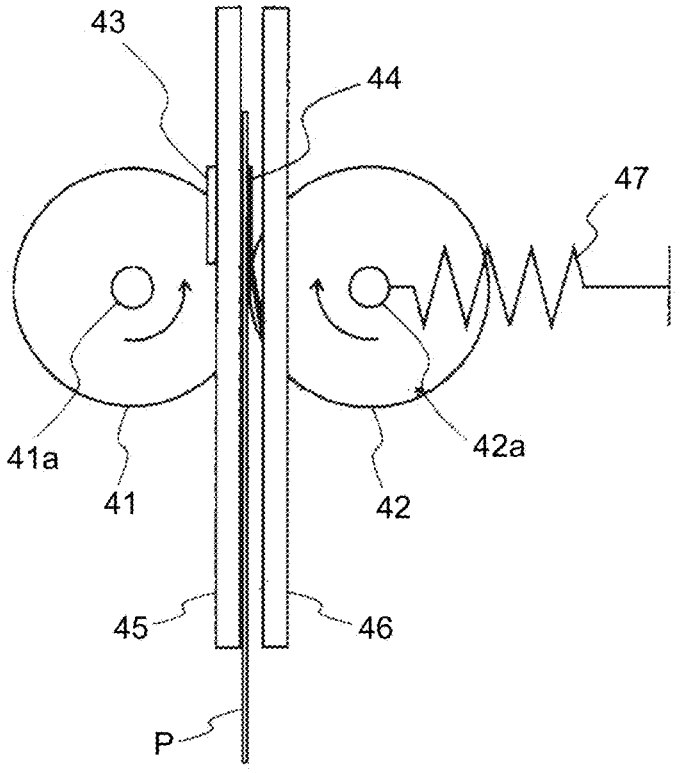
FIG. 3B is a side view illustrating a state in which the paper thickness detection device main body is detecting a paper thickness.
Figure 4:
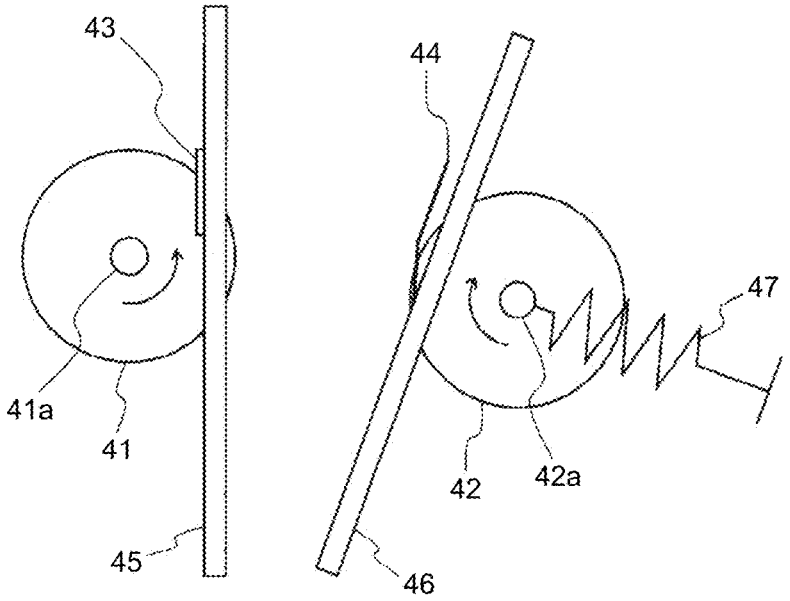
FIG. 4 is a side view illustrating a state in which a driven roller-side conveyance guide plate of the paper thickness detection device main body illustrated in FIGS. 3A and 3B opens up the paper conveyance path.
Figure 5A:
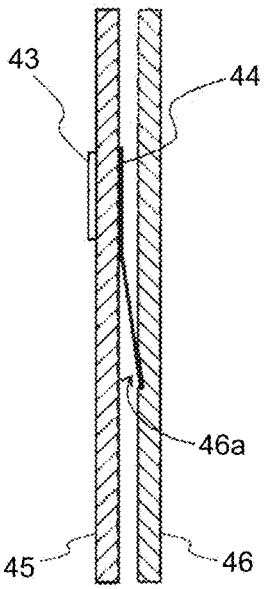
FIGS. 5A to 5C are side views each illustrating a configuration example of a paper pressing plate.
Figure 5B:
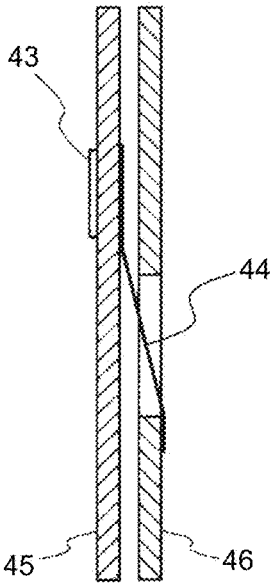
Figure 5C:
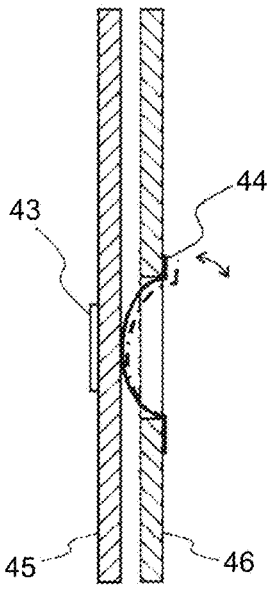

FIG. 3A is a side view illustrating an exemplary configuration of the paper thickness detection device main body 40' according to the present embodiment. FIG. 3B is a side view illustrating a state in which the paper thickness detection device main body 40' is detecting a paper thickness. FIG. 4 is a side view illustrating a state in which a driven roller-side conveyance guide plate of the paper thickness detection device main body 40' illustrated in FIGS. 3A and 3B opens up the paper conveyance path. FIGS. 5A to 5C are side views each illustrating a configuration example of a paper pressing plate 44.

The paper thickness detection device 40 according to the present embodiment includes the paper thickness detection device main body 40' and the paper thickness detection controller 48 illustrated in FIG. 2. The paper thickness detection device main body 40' includes: a driving roller 41 serving as a rotary-driven driving rotor; a driven roller 42, which serves as a driven rotor, arranged so as to be opposed to the driving roller 41; and a magnetic permeability sensor 43 for magnetically detecting a thickness of the paper P. The paper thickness detection device main body 40' further includes: the non-rotating paper pressing plate 44; a driving roller-side conveyance guide plate 45; the driven roller-side conveyance guide plate 46; and a coil spring 47 illustrated in FIGS. 3A and 3B, which serves as biasing means for biasing the driven roller 42 toward the driving roller 41. The magnetic permeability sensor 43 is connected to the paper thickness detection controller 48 having a function as calculation means for calculating the thickness of the paper P on the basis of the detection result of the magnetic permeability sensor 43.

The paper pressing plate 44 has a function as a pressing member (displacement member) for pressing the paper P against the driving roller-side conveyance guide plate 45 while being displaceable in accordance with the thickness of the paper P. The magnetic permeability sensor 43 has a function as a displaced amount detector for magnetically detecting a displaced amount of the paper pressing plate 44 in a contactless manner. The magnetic permeability sensor 43 includes a sensing coil that forms a magnetic circuit so as to pass through a space in which its magnetic permeability changes in accordance with the displacement of the paper pressing plate 44 against the driving roller-side conveyance guide plate 45. The magnetic permeability sensor 43 also includes an oscillation circuit in which its oscillation frequency changes in accordance with the inductance of the sensing coil. The magnetic permeability sensor 43 outputs a signal corresponding to the oscillation frequency of the oscillation circuit. The driving roller-side conveyance guide plate 45 has a function as supporting means for supporting the magnetic permeability sensor 43, and the driven roller-side conveyance guide plate 46 has a function as supporting means for supporting the paper pressing plate 44.

The driven roller 42 is biased toward the driving roller 41 by the coil spring 47. The driven roller 42 is configured to be displaceable in the right direction in FIGS. 3A and 3B in conformity with the thickness of the paper P.

As illustrated in FIG. 5A, the paper pressing plate 44 is fixed to a stepped recess 46*a* formed on a paper conveyance surface side of the driven roller-side conveyance guide plate 46 so that an upstream side of the paper pressing plate 44 in the paper conveyance direction serves as a fixed end. A free end of the paper pressing plate 44 positioned downstream in the paper conveyance direction is configured to be biased against the driving roller-side conveyance guide plate 45 to achieve surface contact therewith. The paper pressing plate 44 is made of a metal plate having magnetic conductivity, for example. The paper pressing plate 44 may be made of a metal plate having non-magnetic conductivity.

Note that the paper pressing plate 44 is not limited to the configuration illustrated in FIG. 5A. As illustrated in FIG. 5B, the paper pressing plate 44 may be fixed to a surface of the driven roller-side conveyance guide plate 46 opposite to the paper conveyance surface, and the free end side thereof may be inserted into an opening and then biased against the driving roller-side conveyance guide plate 45 to achieve surface contact therewith.

Alternatively, the paper pressing plate 44 may be fixed to the surface of the driven roller-side conveyance guide plate 46 opposite to the paper conveyance surface and an intermediate portion thereof may be deformed toward the paper conveyance surface as illustrated in FIG. 5C so as to be biased against the driving roller-side conveyance guide plate 45 via the opening to achieve surface contact therewith. The tip of the free end of such a paper pressing plate 44 can come into and out of contact with a portion positioned on the surface opposite to the paper conveyance surface and positioned opposite to the fixed portion of the opening.

The magnetic permeability sensor 43 is arranged on an outer surface of the driving roller-side conveyance guide plate 45 opposite to a paper conveyance surface. The magnetic permeability sensor 43 is arranged so that the paper pressing plate 44 is opposed to the sensing coil of the magnetic permeability sensor 43 via the driving roller-side conveyance guide plate 45.

Although the magnetic permeability sensor 43 is arranged on the driving roller-side conveyance guide plate 45 and the paper pressing plate 44 is arranged on the driven roller-side conveyance guide plate 46 in the example illustrated in FIGS. 3A and 3B, these may be arranged the other way around. More specifically, the magnetic permeability sensor 43 may be arranged on the driven roller-side conveyance guide plate 46 and the paper pressing plate 44 may be arranged on the driving roller-side conveyance guide plate 45.

The magnetic permeability sensor 43 also outputs a signal corresponding to an oscillation frequency that changes in accordance with a distance between the sensing coil and the paper pressing plate 44. The paper thickness detection controller 48 calculates the thickness of the paper P on the basis of the output signal corresponding to the oscillation frequency outputted from the magnetic permeability sensor 43.

An example of the magnetic permeability sensor 43 may be a magnetic permeability sensor that employs a Colpitts LC oscillation circuit as will be described later. The use of such a magnetic permeability sensor allows the thickness of the paper P to be detected with high accuracy with a resolution of about 5 μm.

A method for detecting a thickness of paper in the configuration in which the magnetic permeability sensor 43 is arranged on the driving roller-side conveyance guide plate 45 and the paper pressing plate 44 is arranged on the driven roller-side conveyance guide plate 46 will be described later.

Note that the paper thickness detection device 40 may be configured so that an upper side of the driven roller-side conveyance guide plate 46 opens up the paper conveyance path with a lower side thereof being used as a pivot as illustrated in FIG. 4. The paper pressing plate 44, the driven roller 42, and the coil spring 47 also move along with the movement of the driven roller-side conveyance guide plate 46. Thus, paper can be removed immediately when paper jam occurs.

Figure 6B:
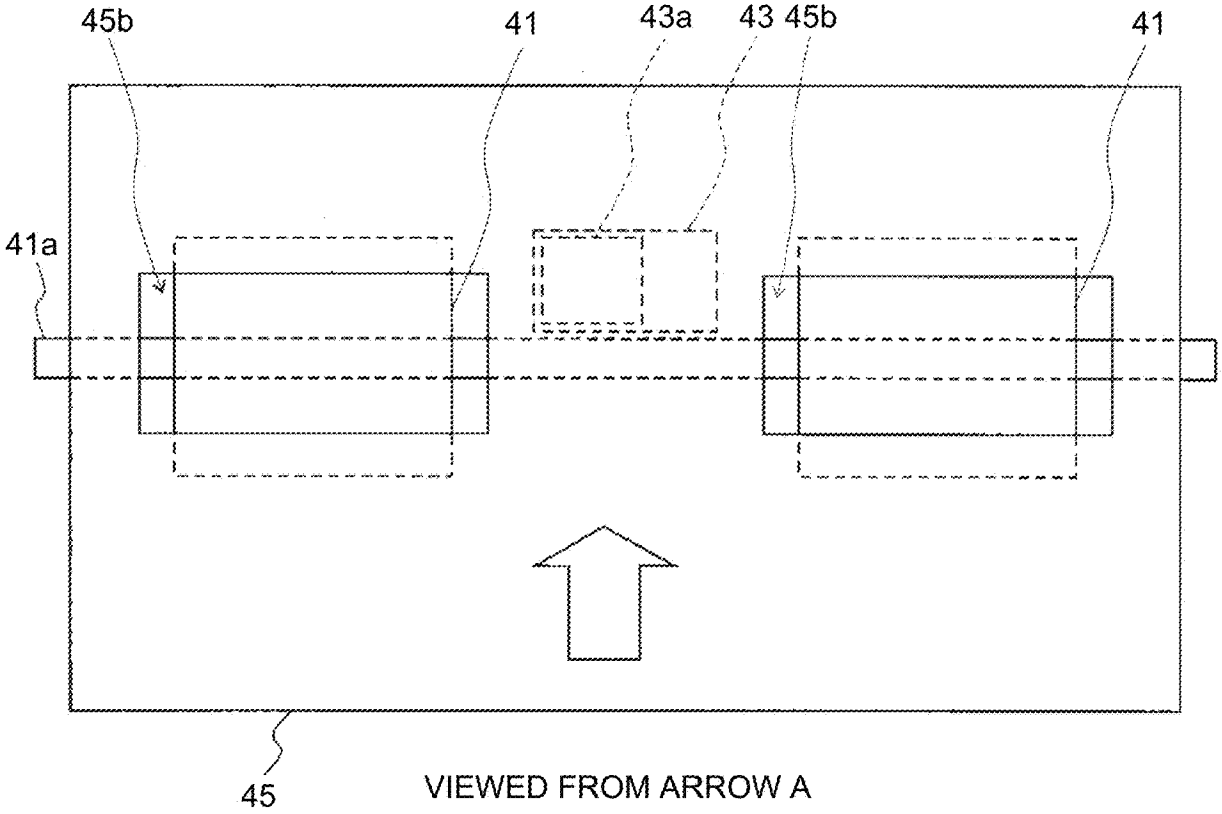
FIG. 6B is a view of the driving roller side of the paper thickness detection device as seen in a direction of arrow A in FIG. 6A.
Figure 6A:
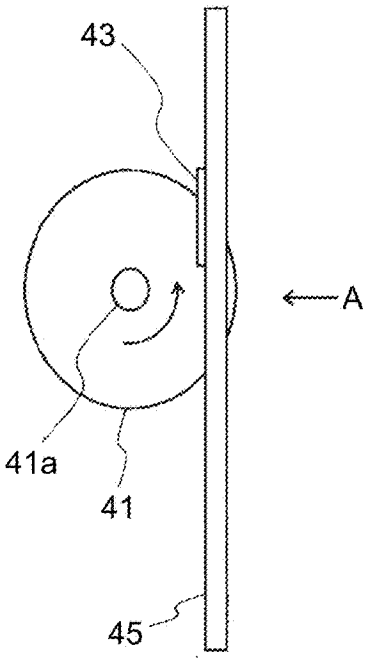
FIG. 6A is a side view illustrating a driving roller side of a paper thickness detection device.
Figure 7B:
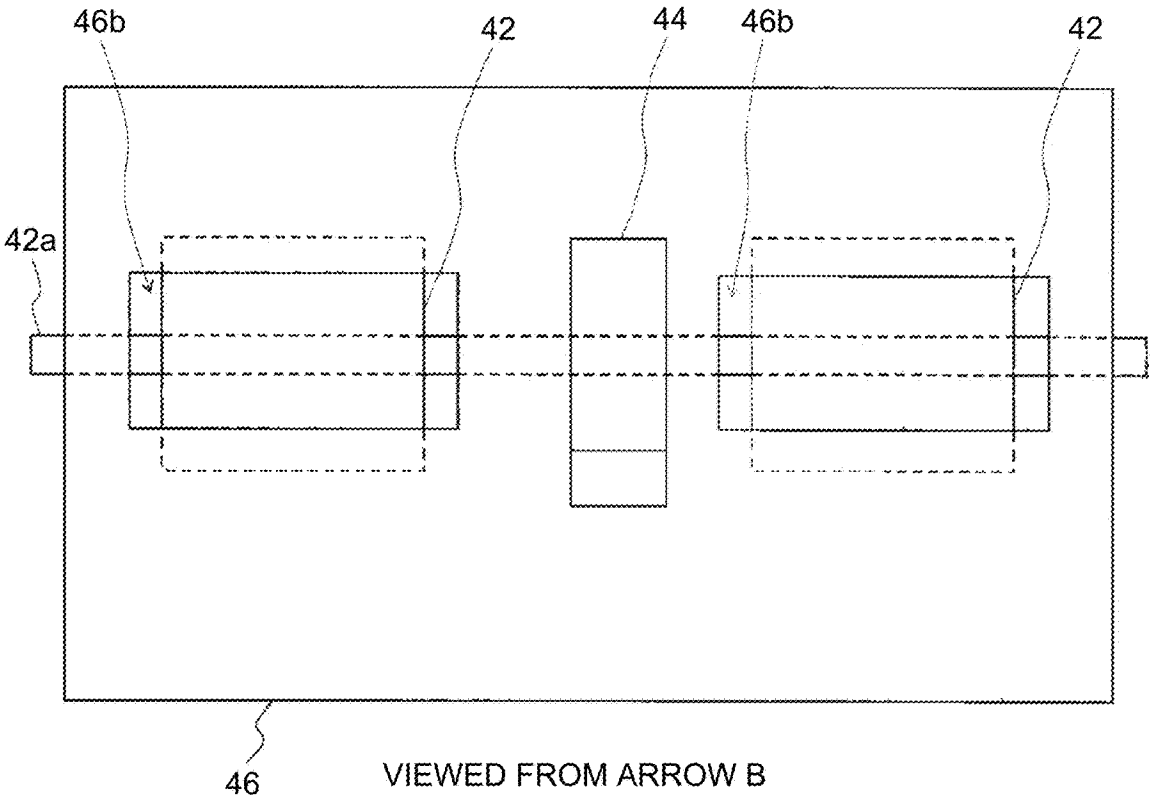
FIG. 7B is a view of the driven roller side of the paper thickness detection device as seen in a direction of arrow B in FIG. 7A.
Figure 7A:
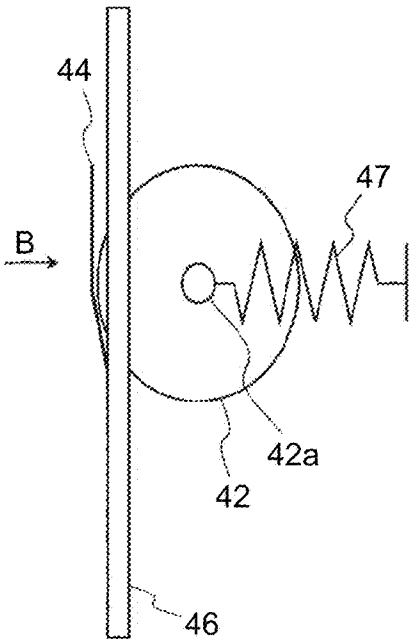
FIG. 7A is a side view illustrating a driven roller side of the paper thickness detection device.
Figure 8A:
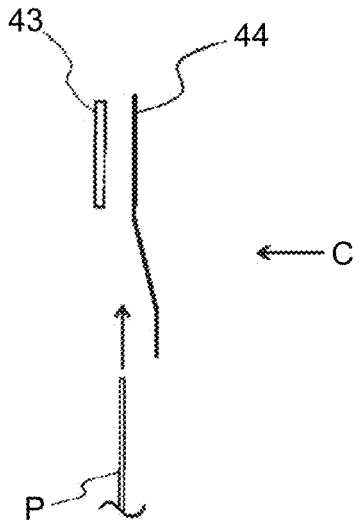
FIG. 8A is a partial enlarged side view of a magnetic permeability sensor and the paper pressing plate.
Figure 8B:
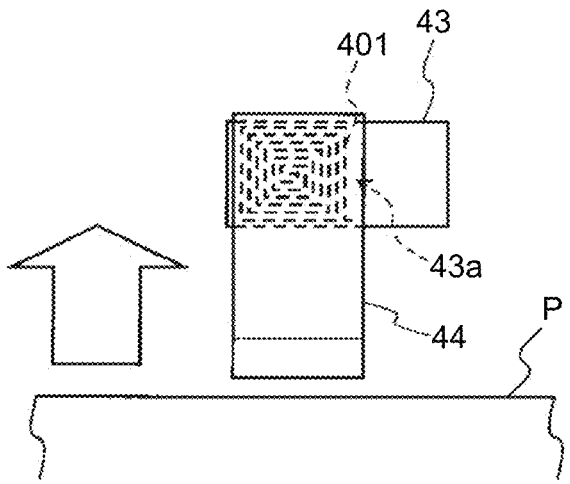
FIG. 8B is a view of the magnetic permeability sensor and the paper pressing plate as seen in a direction of arrow C in FIG. 8A.
Figure 8C:
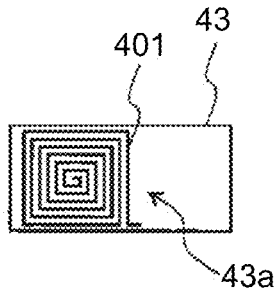
FIG. 8C is a diagram illustrating an example of a detection unit including a sensing coil of the magnetic permeability sensor.

FIGS. 6A and 6B and FIGS. 7A and 7B are diagrams illustrating the paper thickness detection device 40 in a manner divided into a driving roller side and a driven roller side, respectively, with respect to the paper conveyance path. FIG. 6A is a side view of the driving roller side, and FIG. 6B is a view of the driving roller side as seen in a direction of arrow A (from the sheet material conveyance side) in FIG. 6A. FIG. 7A is a side view of the driven roller side, and FIG. 7B is a view of the driven roller side as seen in a direction of arrow B (from the sheet material conveyance side) in FIG. 7A. FIGS. 8A to 8C are partial enlarged views of the magnetic permeability sensor 43 and the paper pressing plate 44. FIG. 8A is a side view, FIG. 8B is a view as seen in a direction of arrow C in FIG. 8A, and FIG. 8C is a diagram illustrating an example of a sensing coil 401 formed in a sensing unit 43*a* of the magnetic permeability sensor 43.

As illustrated in FIG. 6B, two-split pieces of the driving roller 41 are disposed side by side along the shaft direction of a driving roller shaft 41*a*. The two-split pieces of the driving roller 41 are disposed so that parts thereof are exposed toward the paper conveyance surface through two openings 45*b* provided in the driving roller-side conveyance guide plate 45. The pieces of the driving roller 41 are rotary-driven by a drive source such as a motor in the paper conveyance direction.

The magnetic permeability sensor 43 is disposed on the outer surface of the driving roller-side conveyance guide plate 45 at a position near the center between the two-split pieces of the driving roller 41 and downstream of the driving roller shaft 41*a* in the paper conveyance direction. The magnetic permeability sensor 43 includes the sensing coil 401 in the sensing unit 43*a*. The magnetic permeability sensor 43 is disposed at a position where the paper pressing plate 44 covers the sensing unit 43*a* in which the sensing coil 401 is formed (see FIG. 8B).

Note that the magnetic permeability sensor 43 is preferably disposed at a position slightly away from the position having the shortest distance to the driving roller shaft 41*a*. This is because the short distance between the driving roller shaft 41*a*, which is made of a metal, and the magnetic permeability sensor 43 may cause magnetic flux formed by the magnetic permeability sensor 43 to be influenced by the driving roller shaft 41*a*.

Moreover, the magnetic permeability sensor 43 and the paper pressing plate 44 are preferably disposed downstream of the conveyance nip formed by the driving roller 41 and the driven roller 42 in the conveyance direction of the paper P. This is because the paper P may be jammed due to the action of the paper pressing plate 44 if the magnetic permeability sensor 43 and the paper pressing plate 44 are disposed upstream of the conveyance nip in the conveyance direction of the paper P.

As illustrated in FIG. 7B, two-split pieces of the driven roller 42 are disposed side by side along the shaft direction of a driven roller shaft 42*a*. The two-split pieces of the driven roller 42 are disposed so that parts thereof are exposed toward the paper conveyance surface through two openings 46*b* provided in the driven roller-side conveyance guide plate 46.

The paper pressing plate 44 is disposed so that the fixed end thereof is located on the paper conveyance surface of the driven roller-side conveyance guide plate 46 at a position near the center between the two-split pieces of the driven roller 42 and upstream of the driven roller shaft 42*a* in the paper conveyance direction. The free end side of the paper pressing plate 44 is disposed at a position to cover the sensing unit 43*a* of the magnetic permeability sensor 43 in which the sensing coil 401 is formed (see FIG. 8B). The paper pressing plate 44 is made of a material with magnetic conductivity such as a thin iron plate. The fixed end side of the paper pressing plate 44 is fixed to the driven roller-side conveyance guide plate 46 in a manner that the paper pressing plate 44 can elastically deform like a plate spring.

According to the paper thickness detection device 40 with the above-described configuration, the paper P conveyed between the driving roller-side conveyance guide plate 45 and the driven roller-side conveyance guide plate 46 proceeds into the conveyance nip between the driving roller 41 and the driven roller 42 as illustrated in FIG. 3B described above. The paper P sandwiched between and conveyed by the driving roller 41 and the driven roller 42 proceeds into an area between the paper pressing plate 44 and the driving roller-side conveyance guide plate 45. This causes the free end side of the paper pressing plate 44 to be displaced to the right in FIG. 3B in conformity with the thickness of the paper P. This changes the distance between the magnetic permeability sensor 43 and the paper pressing plate 44 and thus changes the signal corresponding to the oscillation frequency outputted from the magnetic permeability sensor 43. The paper thickness detection controller 48 having received this signal corresponding to the oscillation frequency calculates the thickness of the paper P on the basis of a difference (frequency difference) from the initial value of the oscillation frequency when no paper P exists between the paper pressing plate 44 and the driving roller-side conveyance guide plate 45.

The paper thickness detection device 40 according to the present embodiment can achieve high accuracy since this device can directly measure the thickness of the paper P. Moreover, even when the driven roller-side conveyance guide plate 46 vibrates, such vibration is absorbed by the paper pressing plate 44. Thus, no errors occur due to the vibration of the driven roller-side conveyance guide plate 46. Furthermore, an interval between two sheets of paper only needs to be larger than an area where the paper pressing plate 44 is in contact with the driving roller-side conveyance guide plate 45. Thus, such a paper interval can be reduced, thereby achieving a high printing speed.

A configuration example of the magnetic permeability sensor 43 and the paper thickness detection controller 48 used in the paper thickness detection device 40 according to the present embodiment and an example of the method for detecting a paper thickness will be described below more in detail.

Figure 9:
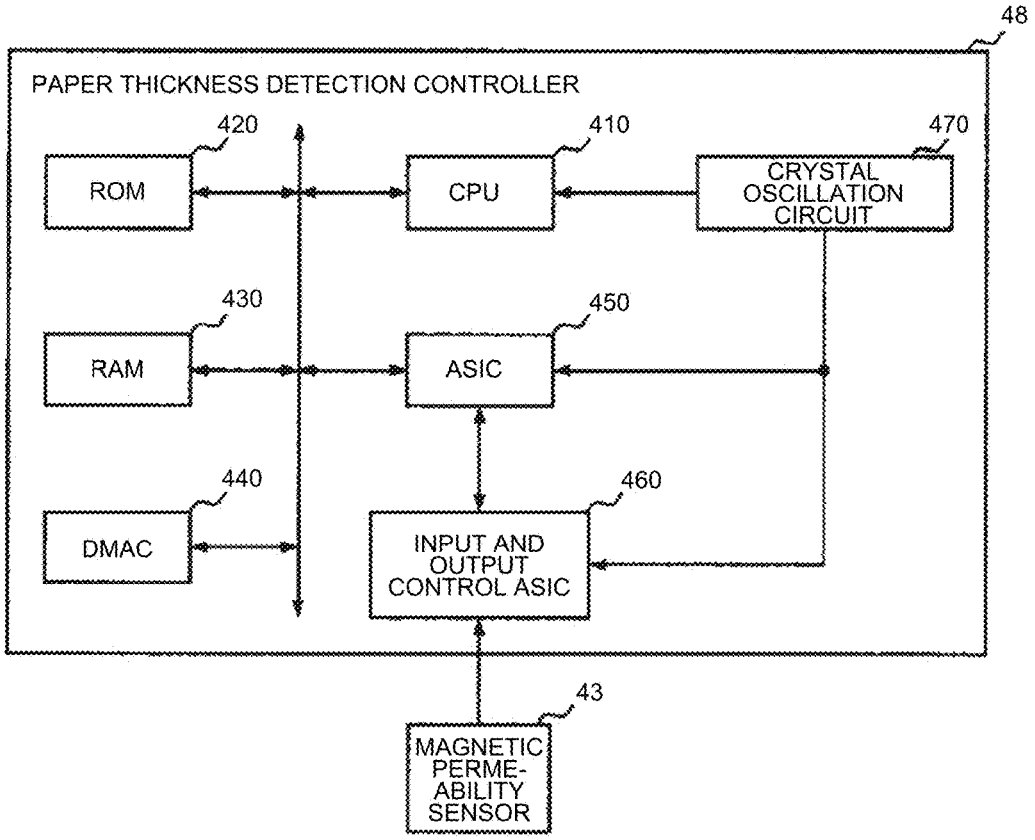
FIG. 9 is a block diagram illustrating an example of the schematic configuration of a paper thickness detection controller.

FIG. 9 is a block diagram illustrating an example of the schematic configuration of the paper thickness detection controller 48. The paper thickness detection controller 48 includes a CPU 410, a ROM 420, a RAM 430, a DMAC 440, an application specific integrated circuit (ASIC) 450, an input and output control ASIC 460, and a crystal oscillation circuit 470.

The CPU 410 is computing means and controls the overall operation of the paper thickness detection controller 48. The ROM 420 is a read-only non-volatile storage medium for storing programs such as firmware. The RAM 430 is a volatile storage medium capable of high-speed reading and writing of information and used as a workspace when the CPU 410 processes information. The DMAC 440 controls direct access to the RAM 430 without the CPU 410. The ASIC 450 functions as a connection interface between a system bus to which the CPU 410, the RAM 430, etc., are connected and another device. The input and output control ASIC 460 acquires a sensing signal outputted by the magnetic permeability sensor 43 and converts the sensing signal into information that can be processed in the paper thickness detection controller 48. The crystal oscillation circuit 470 generates a reference clock for operating the devices in the paper thickness detection controller 48.

Figure 10:
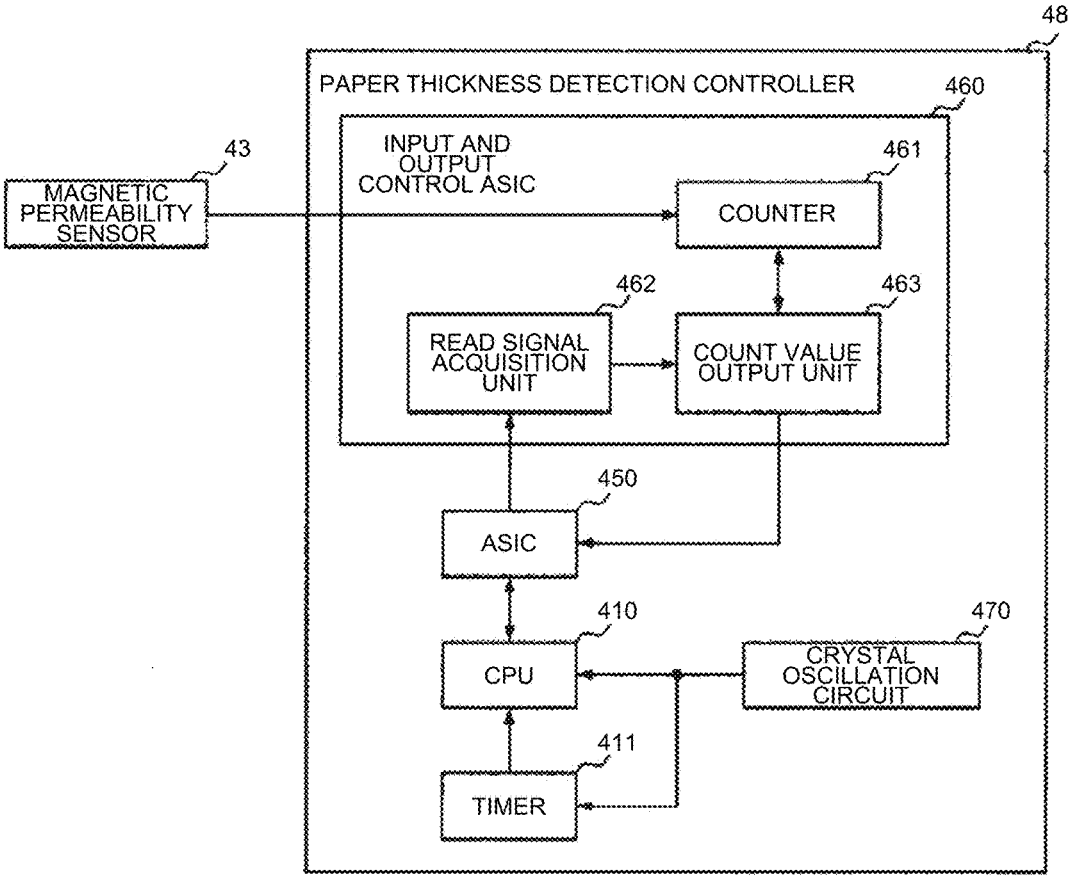
FIG. 10 is a block diagram illustrating a detailed functional configuration of an input and output control ASIC in the paper thickness detection controller.

FIG. 10 is a block diagram illustrating a detailed functional configuration of the input and output control ASIC 460 in the paper thickness detection controller 48. As illustrated in FIG. 10, the input and output control ASIC 460 includes a counter 461, a read signal acquisition unit 462, and a count value output unit 463. The magnetic permeability sensor 43 according to the present embodiment includes the oscillation circuit that outputs a rectangular wave of a frequency corresponding to a magnetic permeability in a sensed space. The counter 461 is a counter that increases a value i.e., increments in accordance with the rectangular wave outputted by the magnetic permeability sensor 43. The counting performed by the counter 461 starts after the front end portion of the paper P enters the nip between the driving roller 41 and the driven roller 42 and ends before the back end of the paper P passes through the nip, for example. Alternatively, the counting performed by the counter 461 may start immediately before the front end of the paper P enters the nip and may end immediately after the front end of the paper P passes through the nip so as to obtain a difference between the counter values acquired immediately before the front end of the paper P enters the nip and acquired immediately after the front end of the paper P passes through the nip. Triggered by the sensing of the front end of the paper P by paper sensors provided immediately downstream of the feed rollers 25 and 26 (see FIGS. 1 and 2) in the paper conveyance direction in the printer main body, for example, control for starting and ending such counting may be performed on the basis of the size and conveyance speed of the paper P.

The read signal acquisition unit 462 acquires a read signal, which is an instruction for acquiring the count value of the counter 461 from the CPU 410, via the ASIC 450. Once acquiring the read signal from the CPU 410, the read signal acquisition unit 462 inputs, to the count value output unit 463, a signal to cause the count value output unit 463 to output the count value. The count value output unit 463 outputs the count value of the counter 461 in accordance with the signal from the read signal acquisition unit 462.

As illustrated in FIG. 10, the paper thickness detection controller 48 includes a timer 411. The timer 411 outputs an interrupt signal to the CPU 410 every time the count value of the reference clock inputted from the crystal oscillation circuit 470 equals a predetermined value. The CPU 410 outputs the above-described read signal in accordance with the interrupt signal inputted from the timer 411.

The access to the input and output control ASIC 460 from the CPU 410 is performed via a register, for example. Thus, the output of the above-mentioned read signal is performed by writing a value into a predetermined register included in the input and output control ASIC 460 by the CPU 410. The output of the count value by the count value output unit 463 is performed by storing the count value in the predetermined register included in the input and output control ASIC 460 and causing the CPU 410 to acquire that value.

Figure 11:
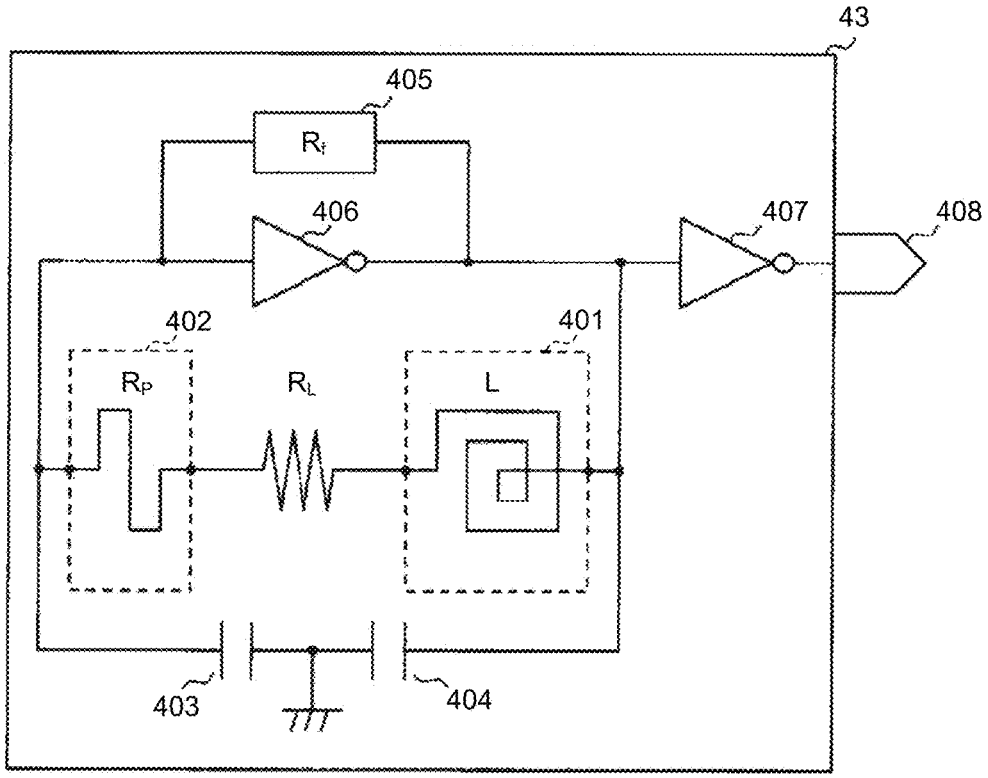
FIG. 11 is a diagram illustrating an example of the internal configuration of the magnetic permeability sensor according to the present embodiment.

FIG. 11 is a diagram illustrating an example of the internal configuration of the magnetic permeability sensor 43 according to the present embodiment. As illustrated in FIG. 11, the magnetic permeability sensor 43 according to the present embodiment includes an oscillation circuit, which is typically a Colpitts LC oscillation circuit. The magnetic permeability sensor 43 includes the sensing coil 401 formed as a plane pattern coil, a first capacitor 403 and a second capacitor 404, a feedback resistor 405, unbuffered ICs 406 and 407, and an output terminal 408.

When a circuit resistance RL generated by a conductive wire that forms the circuit is taken into consideration, an oscillation frequency f of the above-described Colpitts LC oscillation circuit is represented by the following Formula (1).

$$f = \frac{1}{2\pi}\sqrt{\frac{1}{LC} - \left(\frac{R_L + R_P}{2L}\right)^2} \quad (1)$$

The sensing coil 401 is a conductive wire printed-wired on a substrate constituting the magnetic permeability sensor 43, i.e., a planar coil made of a signal wire. As illustrated in FIG. 11, the sensing coil 401 has an inductance L obtained by the coil. In the sensing coil 401, the value of the inductance L is changed by the magnetic permeability of a space opposed to the plane on which the coil is formed. As a result, the magnetic permeability sensor 43 generates a signal with a frequency corresponding to the magnetic permeability of the space opposed to the coil surface of the sensing coil 401. The magnetic permeability of the space opposed to the plane on which the sensing coil 401 is formed herein refers to the magnetic permeability in the range over which the magnetic flux of the magnetic permeability sensor 43 extends. Note that a wound coil or a multilayer chip coil may be used as the sensing coil 401.

The first capacitor 403 and the second capacitor 404 are capacitors that form, together with the sensing coil 401, the Colpitts LC oscillation circuit. Thus, the first capacitor 403 and the second capacitor 404 are connected in series with each other and connected in parallel to the sensing coil 401. A loop constituted by the sensing coil 401, the first capacitor 403, and the second capacitor 404 establishes a resonance current loop.

The feedback resistor 405 is inserted in order to stabilize a bias voltage. The function of the unbuffered ICs 406 and 407 causes a potential fluctuation in part of the resonance current loop to be outputted from the output terminal 408 as a rectangular wave corresponding to the oscillation frequency. With such a configuration, the magnetic permeability sensor 43 according to the present embodiment oscillates at a frequency corresponding to the inductance L, capacitances C of the first capacitor 403 and the second capacitor 404, and the circuit resistance RL to be described later.

The electronic components including the above-described first capacitor 403, second capacitor 404, feedback resistor 405, unbuffered ICs 406 and 407, and output terminal 408 are provided, for example, on a surface of the substrate opposite to the surface on which the sensing coil 401 is formed. Alternatively, in order to prevent the formation of unnecessary protrusions on the surface on which the sensing coil 401 is formed, the electronic components may be manufactured as a surface mount technology (SMT) product.

The inductance L changes in accordance with the above-mentioned displaced amount of the paper pressing plate 44, which is displaced in accordance with the thickness of the paper P in the vicinity of the sensing coil 401. Thus, the thickness of the paper P can be detected on the basis of the oscillation frequency of the magnetic permeability sensor 43.

Figure 12:
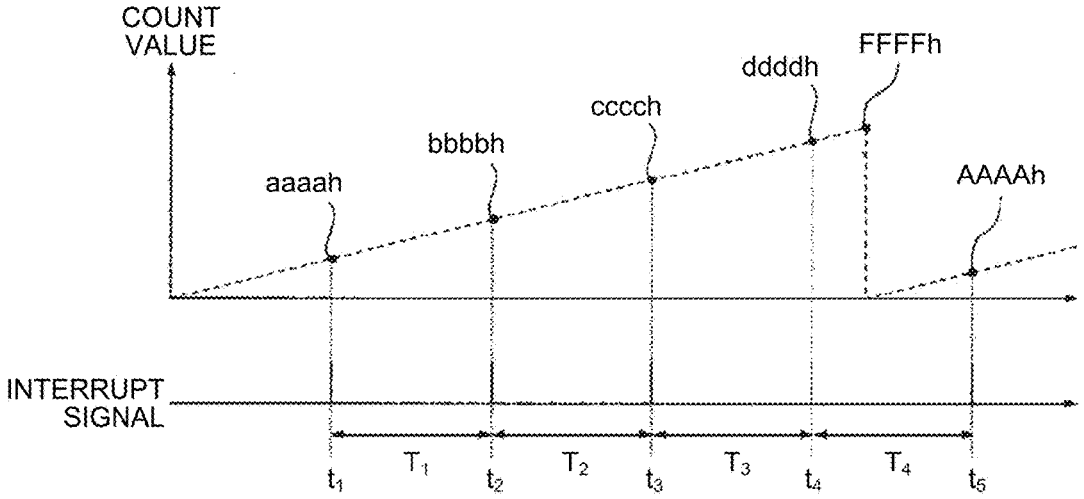
FIG. 12 is a diagram illustrating an exemplary aspect of a count value on the output of the magnetic permeability sensor, which is counted by the paper thickness detection controller according to the present embodiment.

FIG. 12 is a diagram illustrating an exemplary aspect of a count value on the output of the magnetic permeability sensor 43, which is counted by the function of the input and output control ASIC 460 of the paper thickness detection controller 48 according to the present embodiment. When no paper exists in a region of the conveyance path opposed to the magnetic permeability sensor 43 and thus no displacement of the paper pressing plate 44 occurs, the magnetic permeability sensor 43 continues to oscillate at the same frequency in principle. As a result, the count value of the counter 461 uniformly increases over time as illustrated in FIG. 12.

When the timer 411 inputs an interrupt signal to the CPU 410, the CPU 410 outputs the read signal to the input and output control ASIC 460 and thereby acquires the count value of the counter 461 at that timing. As illustrated in FIG. 12, count values such as aaaah, bbbbh, cccch, ddddh, and AAAAh are acquired at timings $t_1$, $t_2$, $t_3$, $t_4$, and $t_5$, respectively.

Once acquiring the count values at the respective timings, the CPU 410 calculates a frequency in each of periods $T_1$, $T_2$, $T_3$, and $T_4$ illustrated in FIG. 12. When the timer 411 counts the reference clock corresponding to 2 (msec), for example, the timer 411 outputs the interrupt signal. Therefore, the CPU 410 calculates the oscillation frequency f (Hz)

of the magnetic permeability sensor 43 in each of the periods $T_1$, $T_2$, $T_3$, and $T_4$ illustrated in FIG. 12 by dividing the count value of the counter 461 in each period by 2 (msec).

As illustrated in FIG. 12, the upper limit of the count value of the counter 461 is FFFFh. Therefore, when calculating the frequency in the period $T_4$, the CPU 410 calculates the oscillation frequency f (Hz) by dividing the sum of the value obtained by subtracting ddddh from FFFFh and the value of AAAAh by 2 (msec).

Figure 13:
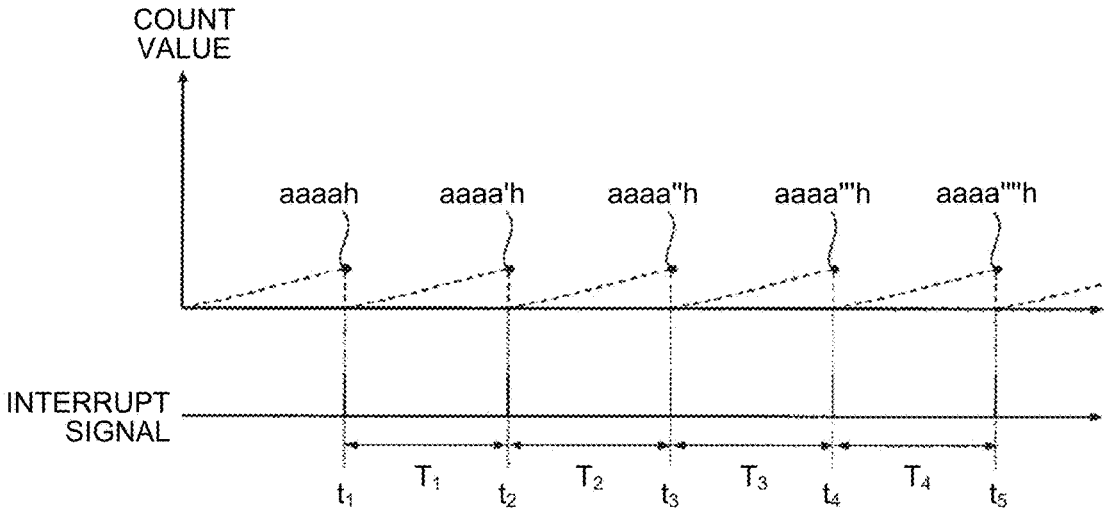
FIG. 13 is a diagram illustrating another aspect of the count value on the output of the magnetic permeability sensor, which is counted by a function of the input and output control ASIC of the paper thickness detection controller according to the present embodiment.

FIG. 13 is a diagram illustrating another aspect of the count value on the output of the magnetic permeability sensor 43, which is counted by the function of the input and output control ASIC 460 of the paper thickness detection controller 48 according to the present embodiment. In the case of FIG. 13, after a count value is read out by the count value output unit 463 in the input and output control ASIC 460, the counter 461 resets the counter value. Such a reset process may be performed by inputting a reset signal to the counter 461 after the count value output unit 463 reads out the count value. Alternatively, the counter 461 may be provided with a function to reset a count value once the count value is read out as one feature of the counter 461.

In the case of the aspect illustrated in FIG. 13, count values acquired at respective timings are values counted in the respective periods $T_1$, $T_2$, $T_3$, and $T_4$. Therefore, the CPU 410 calculates the oscillation frequency f (Hz) by dividing the count value acquired at each timing by 2 (msec).

As described above, in the paper thickness detection controller 48 according to the present embodiment, the frequency of the signal generated by the magnetic permeability sensor 43 is acquired, and the thickness of the paper P corresponding to the oscillation frequency of the magnetic permeability sensor 43 can be calculated on the basis of the acquired result. In the magnetic permeability sensor 43 according to the present embodiment, the inductance L changes in accordance with the displaced amount of the paper pressing plate 44 present in the space opposed to the coil surface of the sensing coil 401. This changes the frequency of the signal outputted from the output terminal 408. As a result, the paper thickness detection controller 48 can detect the thickness of the paper P traveling through the region of the conveyance path opposed to the coil surface of the sensing coil 401.

Figure 14:
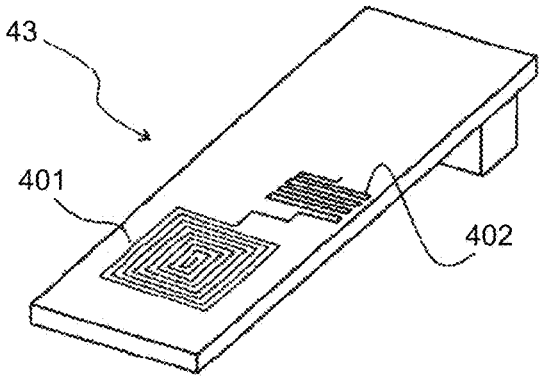
FIG. 14 is a perspective view illustrating an example of the appearance of the magnetic permeability sensor according to the present embodiment.

FIG. 14 is a perspective view illustrating an example of the appearance of the magnetic permeability sensor 43 according to the present embodiment. In FIG. 14, the magnetic permeability sensor 43 is placed with the substrate surface on which the sensing coil 401 formed as a plane pattern coil and a pattern resistor 402 formed as a plane resistor are formed, i.e., a sensing surface to be opposed to the space in which the paper pressing plate 44 is displaced in accordance with the thickness of the paper P, facing upward.

As illustrated in FIG. 14, the pattern resistor 402 connected in series with the sensing coil 401 is printed-wired on the sensing surface on which the sensing coil 401 is provided. As explained above with reference to FIG. 11, the sensing coil 401 is formed by the conductive wire, which serves as the signal wire, printed-wired in a spiral manner on the substrate. The pattern resistor 402 is formed by a conductive wire, which serves as a signal wire, printed-wired in a zigzag manner on the substrate. These patterns implement the function of the magnetic permeability sensor 43 as described above.

The substrate surface on which the sensing coil 401 is formed is the sensing unit for a magnetic permeability in the magnetic permeability sensor 43 according to the present embodiment. The magnetic permeability sensor 43 is attached so that the sensing unit is opposed to the above-described space in which the paper pressing plate 44 is displaced in accordance with the thickness of the paper P. The magnetic permeability sensor 43 and the paper pressing plate 44 are attached so that the magnetic permeability sensor 43 generates magnetic flux toward the space in which the paper pressing plate 44 is displaced in accordance with the thickness of the paper P and the paper pressing plate 44 is displaced in the range over which the magnetic flux extends.

Figure 15:
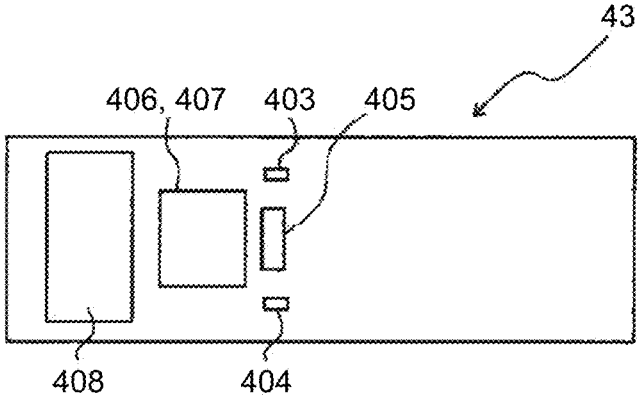
FIG. 15 is a rear view illustrating the magnetic permeability sensor of the present embodiment as seen from a surface opposite to a surface on which the sensing coil is formed.

FIG. 15 is a rear view illustrating the magnetic permeability sensor 43 according to the present embodiment as seen from the surface opposite to the surface on which the sensing coil 401 is formed. The first capacitor 403, the second capacitor 404, the feedback resistor 405, the unbuffered ICs 406 and 407, and the output terminal 408 are formed on the substrate surface opposite to the substrate surface on which the sensing coil 401 is formed in the substrate that constitutes the magnetic permeability sensor 43. This can roughly eliminate unevenness on the surface of the magnetic permeability sensor 43 to be attached to the driving roller-side conveyance guide plate 45. Thus, the magnetic permeability sensor 43 can be provided so that the substrate surface on which the sensing coil 401, i.e., the portion exhibiting a sensing function in the magnetic permeability sensor 43, is provided is in contact with the driving roller-side conveyance guide plate 45 while being opposed to the above-described predetermined space in which the magnetic permeability is sensed.

On the substrate surface on the reverse side of the substrate surface provided with the sensing coil 401, no electronic components and signal wires are mounted in a region overlapping with the region where the sensing coil 401 is provided. This can prevent the sensing of the magnetic permeability by the sensing coil 401 to be influenced by other electronic components or conductive wires, thus improving the sensing accuracy of the magnetic permeability.

Figure 16:
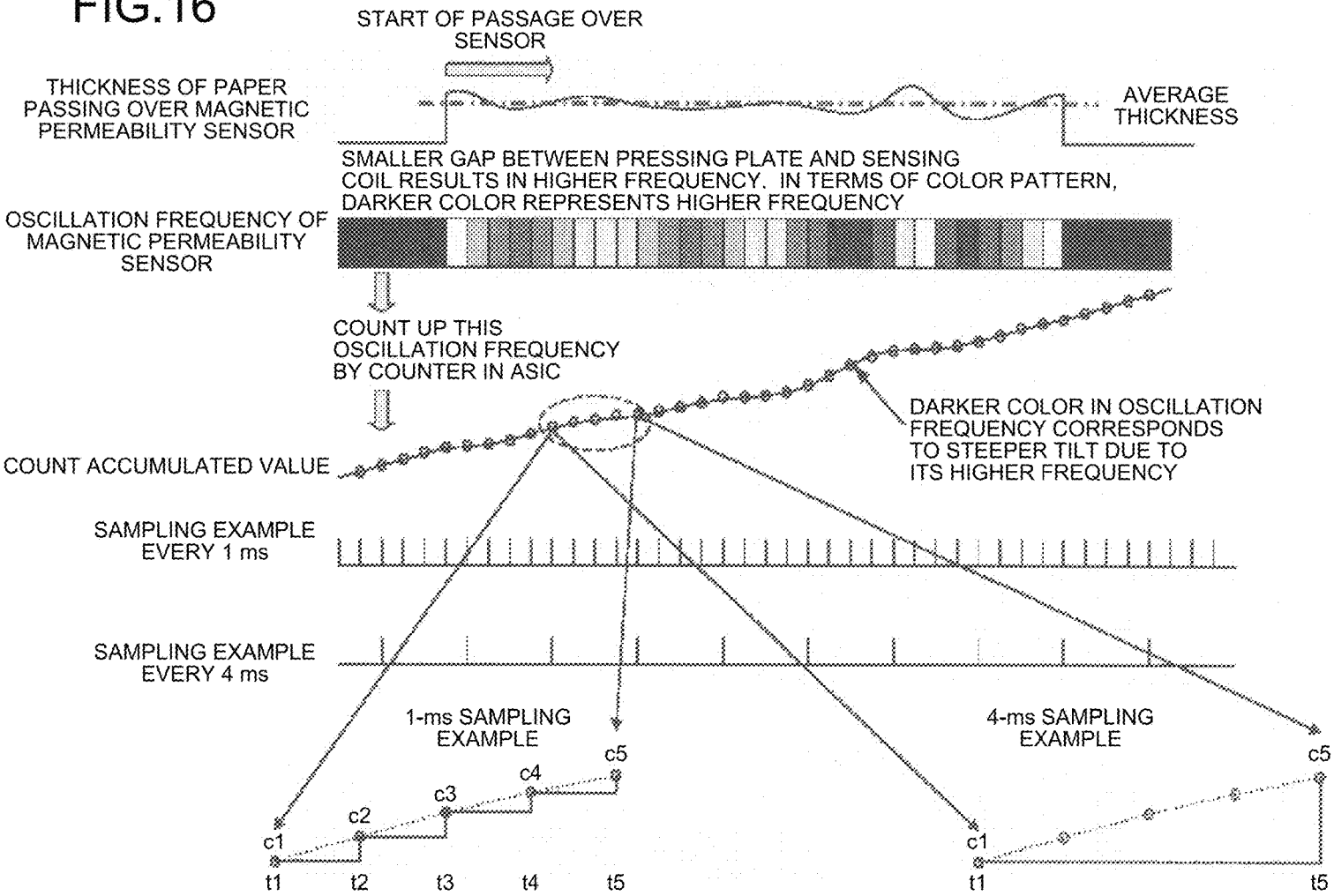
FIG. 16 is a graph used for explaining a change in oscillation frequency output of the magnetic permeability sensor when the paper pressing plate is displaced by passage of paper.

FIG. 16 is a graph used for explaining a change in oscillation frequency output of the magnetic permeability sensor 43 when the paper pressing plate 44 is displaced by the passage of the paper P. Note that the magnetic permeability sensor 43 is configured to generate a higher oscillation frequency when a gap with the paper pressing plate 44 is smaller and generate a lower oscillation frequency when such a gap is larger.

In FIG. 16, the oscillation frequency outputted from the magnetic permeability sensor 43 is counted up by the counter in the ASIC. When the present inventor compared the average of counter accumulated values obtained by performing sampling every 1 ms with the average of counter accumulated values obtained by performing sampling every 4 ms, those averages were equal to each other. Thus, fine sampling and coarse sampling make no difference about detection accuracy. By further developing this idea, an average oscillation frequency can be obtained by the following Formula (2) where ts is a time when the passage of paper starts, cs is a count value, to is a time when the passage of the paper ends, and ce is a count value.

$$\text{Average oscillation frequency}=(ce-cs)/(te-ts) \quad (2)$$

Figure 17:
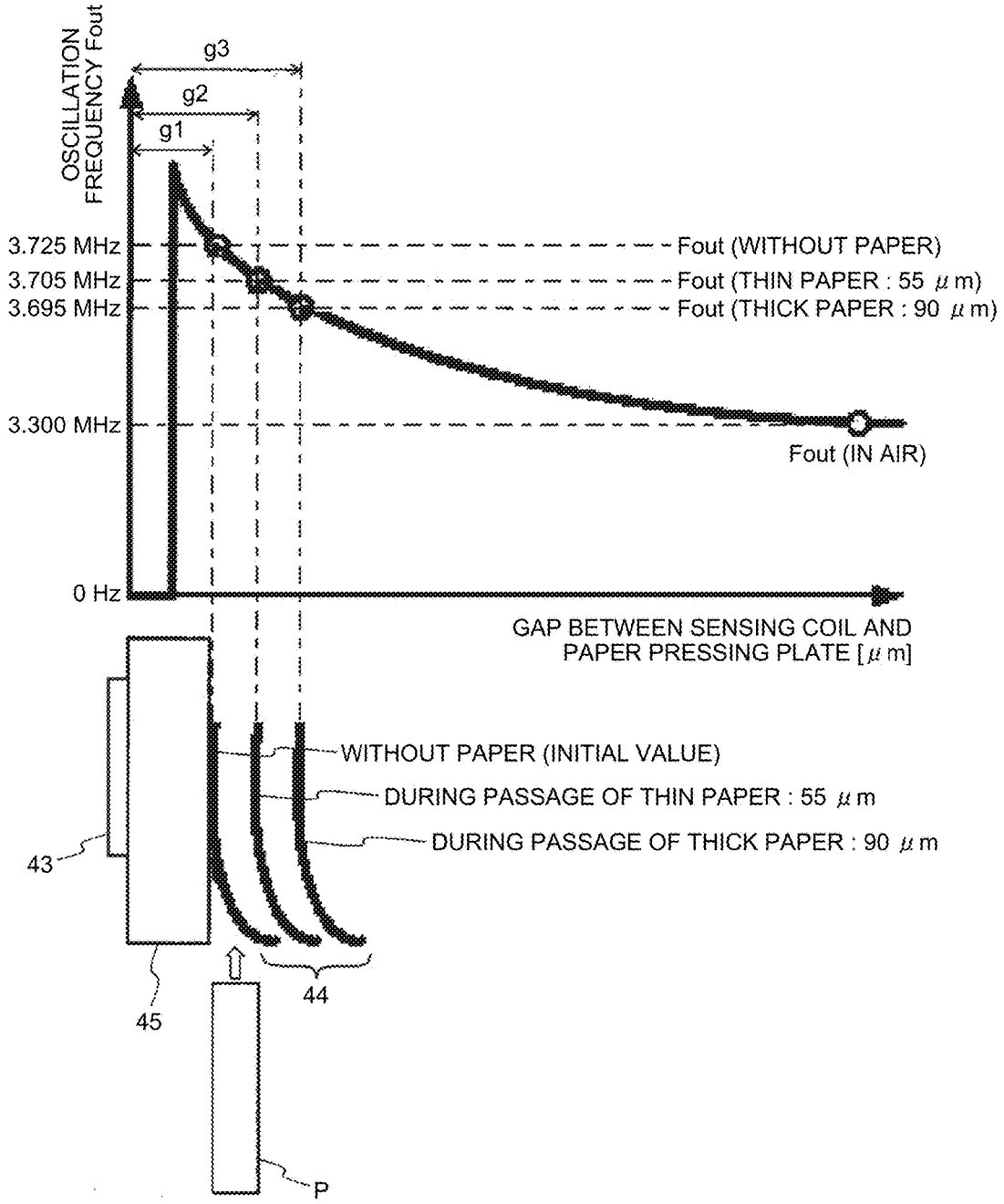
FIG. 17 is a graph illustrating an exemplary relationship between a thickness of paper and an oscillation frequency of the magnetic permeability sensor.

FIG. 17 is a graph illustrating an exemplary relationship between the thickness of the paper P and the oscillation frequency of the magnetic permeability sensor 43.

In FIG. 17, the oscillation frequency outputted in the case of a gap g1 between the magnetic permeability sensor 43 and the paper pressing plate 44 in the absence of paper (=the thickness of the driving roller-side conveyance guide plate 45) is 3.725 MHz. The oscillation frequency outputted in the case of a gap g2 between the magnetic permeability sensor 43 and the paper pressing plate 44 in the presence of thin paper with a thickness of 55 μm is 3.705 MHz. The oscillation frequency outputted in the case of a gap g3 between the magnetic permeability sensor 43 and the paper pressing plate 44 in the presence of thick paper with a thickness of 90 μm is 3.695 MHz. In this manner, a change in gap g between the magnetic permeability sensor 43 and the paper pressing plate 44 due to a thickness of paper leads to a change in oscillation frequency outputted from the magnetic permeability sensor 43. On the basis of such a change, the thickness of the paper P can be detected.

Table 1 is a table showing one example of a conversion table used when determining a type of paper on the basis of a frequency change Δf (kHz) from the initial value (in the absence of paper) of the oscillation frequency of the magnetic permeability sensor 43 in the paper thickness detection controller 48. With reference to the conversion table in Table 1, when the frequency change Δf from the initial value of the oscillation frequency of the magnetic permeability sensor 43 is in a range of 0 kHz or more and 9.9 kHz or less, the type of paper is determined as ultra-thin paper. Similarly, when the frequency change Δf from the initial value is in a range of 10 kHz or more and 19.9 kHz or less, the type of paper is determined as 55-μm paper. When the frequency change Δf from the initial value is in a range of 20 kHz or more and 35 kHz or less, the type of paper is determined as 90-μm paper. When the frequency change Δf from the initial value is in a range of 36 kHz or more and 40 kHz or less, the type of paper is determined as 150-μm paper. When the frequency change Δf from the initial value is in a range of 41 kHz or more, the type of paper is determined as ultra-thick paper.

TABLE 1

| Frequency change from initial value of oscillation frequency Δf [kHz] | Type of paper |
|---|---|
| 0 to 9.9 | Ultra-thin paper |
| 10 to 19.9 | 55-μm paper |
| 20 to 35 | 90-μm paper |
| 36 to 40 | 150-μm paper |
| 41 or more | Ultra-thick paper |

Figure 18:
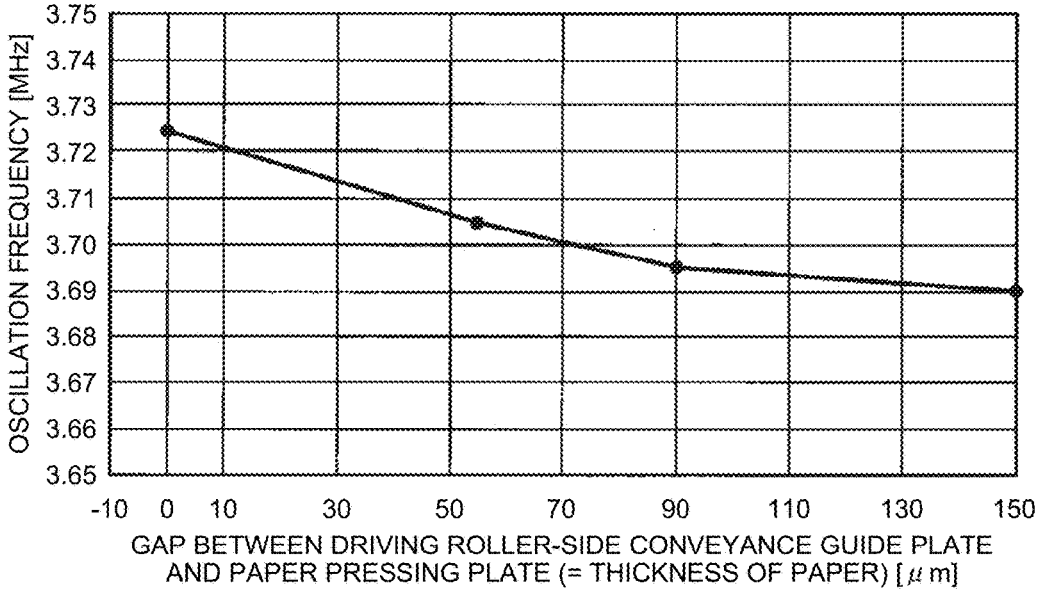
FIG. 18 is a graph illustrating an exemplary relationship between a gap between a driving roller-side conveyance guide plate and the paper pressing plate (=a thickness of paper) and an oscillation frequency.

FIG. 18 is a graph of an exemplary relationship between a gap between the driving roller-side conveyance guide plate 45 and the paper pressing plate 44 the thickness of the paper P) and the oscillation frequency f. Note that a value on the horizontal axis of the graph in FIG. 18 is an offset value obtained by subtracting the thickness of the driving roller-side conveyance guide plate 45 corresponding to g1 in FIG. 17 from the gap g (μm) between the sensing coil of the magnetic permeability sensor 43 and the paper pressing plate 44. On the basis of the graph of FIG. 18, the following Formula (3), for example, can be obtained as an approximation formula for expressing the relationship between the gap (μm) between the sensing coil of the magnetic permeability sensor 43 and the paper pressing plate 44 and the oscillation frequency f (MHz). With the use of Approximation Formula (3) and data on the thickness of the driving roller-side conveyance guide plate 45, the thickness (μm) of the paper P being conveyed may be calculated from the oscillation frequency f (MHz) of the magnetic permeability sensor 43.

$$f=1\times10^{-6}\times g^2-0.0004\times g+3.7247 \quad (3)$$

Although the method for detecting the thickness of the paper P on the basis of the oscillation frequency of the magnetic permeability sensor 43 that changes in accordance with the displaced amount of the paper pressing plate 44 made of a magnetic material has been described in the above-described embodiment, the magnetic permeability sensor 43 is not limited to such a configuration. For example, a magnetic permeability sensor in which an oscillation frequency outputted therefrom changes in accordance with a displaced amount of the paper pressing plate 44 made of a non-magnetic material may be employed. Alternatively, a magnetic permeability sensor in which a voltage or current of an output signal changes in accordance with a displaced amount of the paper pressing plate 44 may be employed.

Although the above-described embodiment employs the sensor for magnetically detecting a displaced amount of the paper pressing plate 44 that is displaced in accordance with a thickness of the paper P, a sensor for electrically detecting a displaced amount of the paper pressing plate 44 may be employed instead. For example, the paper pressing plate 44 is formed with a conductive material and a counter electrode is provided so as to be opposed to the paper pressing plate 44. An electric field (alternating electric field or electrostatic field) may be formed between the counter electrode and the paper pressing plate 44 that is displaced in accordance with a thickness of the paper P, and a sensor for detecting a change in such an electric field may be employed.

As will be described below, an anomaly of a sheet material may be detected through the use of the principle for detecting the thickness of a sheet material with the sensor of the above-described embodiment. The anomaly detection of a sheet material may be performed together with the thickness detection of the sheet material or separately from the thickness detection of the sheet material. Alternatively, a sheet anomaly detection device for detecting an anomaly of a sheet material, which performs thickness detection of the sheet material as described above, may be configured through the use of the principle for detecting the thickness of a sheet material with the sensor of the above-described embodiment.

Examples of a sheet feeder may include an auto document feeding device (also referred to as an auto document feeder (ADF)) included in an image forming device, such as a copier or a multifunction peripheral, for feeding a document as a sheet material. In the auto document feeding device, documents bound together with a staple (hereinafter referred to also as "stapled") may be mistakenly set. In order to detect such stapled documents, a technology for detecting skew at the front end of a document at detection timing of a plurality of paper sensors positioned downstream of a feed roller in a document conveyance direction after the document is fed by a pickup roller has been known in the art (see Japanese Unexamined Patent Application Publication No. 08-119492). According to such a technology, upon the detection of skew at the front end of a document, it is determined that the document is stapled, thus stopping the conveyance of the document. The device can further signal an error to prompt an operator to remove the document and restart the device. Since such stapling is detected at the timing after the document is fed by the pickup roller, however, the document may be damaged. The damage of a document as used herein refers to the crinkling of a document or the blemishing of a document by a roller trace of the pickup roller due to the forceful feeding of the document, for example. If such a damage is given to an important document, a significant impact may be caused. Also, the stapled documents fed into the auto document feeding device may cause a significant damage on the device due to the staple stuck into a narrow and small portion in the auto document feeding device.

A technology for detecting a staple or clip with a metal detection sensor provided for detecting documents bound together with a metal staple of a stapler or with a clip has been known in the art (see Japanese Unexamined Patent Application Publication No. 08-113387 and Japanese Unexamined Patent Application Publication No. 2005-263339). Such a technology, however, cannot detect an anomaly of documents bound together without the use of a metal such as a staple or clip.

Furthermore, a conveyance failure or reading failure of a document may occur if an edge of the document set in the auto document feeding device is folded or the front end thereof is curled up.

In view of this, an auto document feeding device may be configured to detect anomalies of documents to be fed, which are conveyed by feed rollers thereof. The anomalies of documents as used herein refer to documents with a staple or clip, documents with a portion bound together in a staple-less manner without the use of a metal (hereinafter referred to also as a "staple-less bound portion"), a document with a folded edge or curled front end, etc. For example, an auto document feeding device may be configured to detect a foreign object, such as a staple or clip, at an edge of a document fed by the auto document feeding device and detect the staple-less bound portion as an anomaly. The auto document feeding device may also be configured to detect the folded edge or curled front end of a document as an anomaly.

Figure 20:
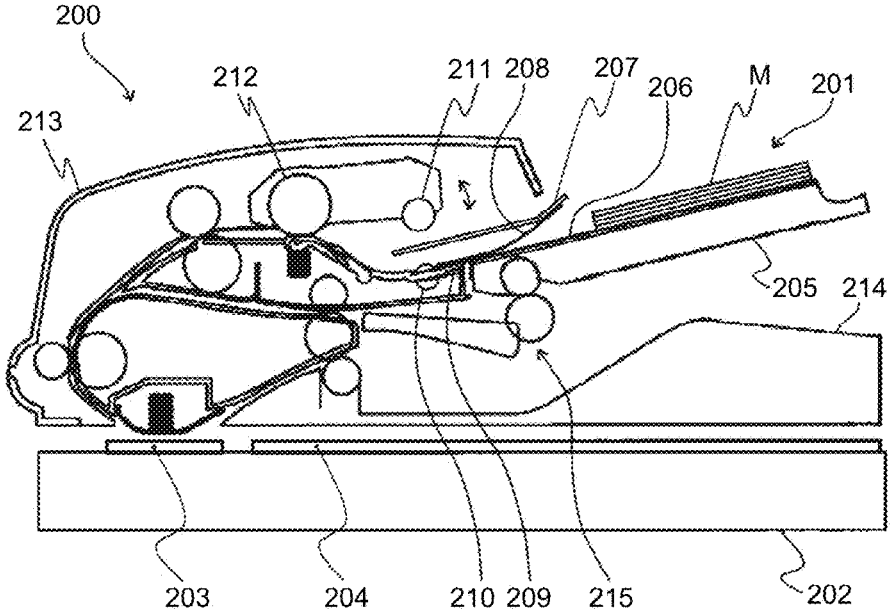
FIG. 20 is a schematic configuration diagram illustrating an example of an auto document feeding device provided with the magnetic permeability sensor of the present embodiment.

FIG. 20 is a schematic configuration diagram illustrating an example of an auto document feeding device 200 provided with a magnetic permeability sensor. The auto document feeding device 200 illustrated in FIG. 20, which is provided as a second sheet feeder, can detect an anomaly of a document by detecting the thickness of an edge of the document as a second sheet material with the above-described magnetic permeability sensor. This is the device capable of detecting anomalies such as stapled or clipped documents, documents bound together without a staple, and a document with a folded edge or curled front end at a stage before conveying a document M, for example. Alternatively, the auto document feeding device 200 may be configured, in combination with the configuration of the above-described printer 100, as an image forming device, such as a copier or a multifunction peripheral, for forming an image of the document M on the paper P.

In FIG. 20, the auto document feeding device 200 is pivotally attached over an image reading device 202, which serves as an image reader such as a scanner, so as to be openable and closable via, for example, a hinge provided on the back side in the figure. The image reading device 202 includes a slit glass 203 and a contact glass 204 provided at image reading positions on an upper surface thereof. A document M or a plurality of documents M set with an image surface(s) thereof facing upward on a first document conveyance guide plate 206 for guiding the document M from below on a tray main body 205 of a paper feeding tray 201 are sent out and conveyed by the auto document feeding device 200. The image reading device 202 reads the image of the document M when the document M passes over the slit glass 203. The image reading device 202 can also read a document set on the contact glass 204 with the image surface thereof facing downward. Note that the first document conveyance guide plate 206 has a function as a guide member for guiding one side of the document M.

The paper feeding tray 201 is provided with a second document conveyance guide plate 207 for guiding the document M from above, a document holding plate 208 serving as a pressing member held by the second document conveyance guide plate 207, a magnetic permeability sensor 209, and a lower feed roller 210. The document holding plate 208 is fixed to the second document conveyance guide plate 207 so that an upstream side of the document holding plate 208 in the document conveyance direction serves as a fixed end. A free end of the document holding plate 208 positioned downstream in the document conveyance direction is biased against the first document conveyance guide plate 206 to achieve surface contact therewith. The document holding plate 208 is made of a metal plate having magnetic conductivity, for example. The document holding plate 208 may be made of a metal plate having non-magnetic conductivity.

The magnetic permeability sensor 209 outputs a signal corresponding to an oscillation frequency that changes in accordance with a distance between a sensing coil and the document holding plate 208 changed by a raise of the document holding plate 208 by the document M set on the first document conveyance guide plate 206. The output signal of the magnetic permeability sensor 209 is inputted to a document detection controller. The document detection controller then calculates the thickness of the document M on the basis of the output signal corresponding to the oscillation frequency outputted from the magnetic permeability sensor 209. Simultaneously with calculation about the thickness of the document M, the document detection controller may detect that the document M has been set between the first document conveyance guide plate 206 and the document holding plate 208. The calculation about the thickness of the document M set between the first document conveyance guide plate 206 and the document holding plate 208 will be described later.

An openable and closable paper feed cover 213 is provided in the auto document feeding device 200 so as to cover a document conveyor including members such as an upper feed roller 211 and a roller 212. The upper feed roller 211 is disposed so as to be able to come into and out of contact with the lower feed roller 210. The upper feed roller 211 normally stands by with a predetermined distance to the lower feed roller 210. Once the document M set between the first document conveyance guide plate 206 and the document holding plate 208 is detected on the basis of the output signal of the magnetic permeability sensor 209, the upper feed roller 211 descends from the standby position to a position in contact with the upper surface of the document M. Next, the upper feed roller 211 and the lower feed roller 210 together work to separate a single document M from a bundle of documents M sequentially from the top and convey the document M toward the slit glass 203. At the slit glass 203, the image of the document M is read. The document M subjected to the reading of the image at the reading position of the slit glass 203 in the image reading device 202 is conveyed to and stacked on a document stack table 214.

The auto document feeding device 200 can select between a single-sided reading mode and a double-sided reading mode in accordance with an instruction from an operating unit such as an operating panel, and the auto document feeding device 200 is provided with a document inverting conveyance unit 215 used in the double-sided reading mode. When the double-sided reading mode is selected, the document M subjected to the reading of an image on the front side at the document reading position of the slit glass 203 is sent to the document inverting conveyance unit 215. The document M is then conveyed again to the document reading position of the slit glass 203 so that an image on the back side can be read. Thereafter, the document M is conveyed to and stacked on the document stack table 214.

The detection about the completion of the setting of the document M on the first document conveyance guide plate 206 may be performed by separately providing a document setting sensor such as a document sensing filler, rather than being based on the output signal of the magnetic permeability sensor 209. Alternatively, the upper feed roller 211 may normally stand by while being in contact with the lower feed roller 210, and the upper feed roller 211 may ascend at the time of maintenance, for example, so as to be separated from the lower feed roller 210. Alternatively, the upper feed roller 211 may pick up a single document M sequentially from the top among a bundle of documents M, and the roller 212 and a separation pad positioned downstream in the document conveyance direction may be used to ensure the separation of the documents M on a one-by-one basis.

Figure 21A:
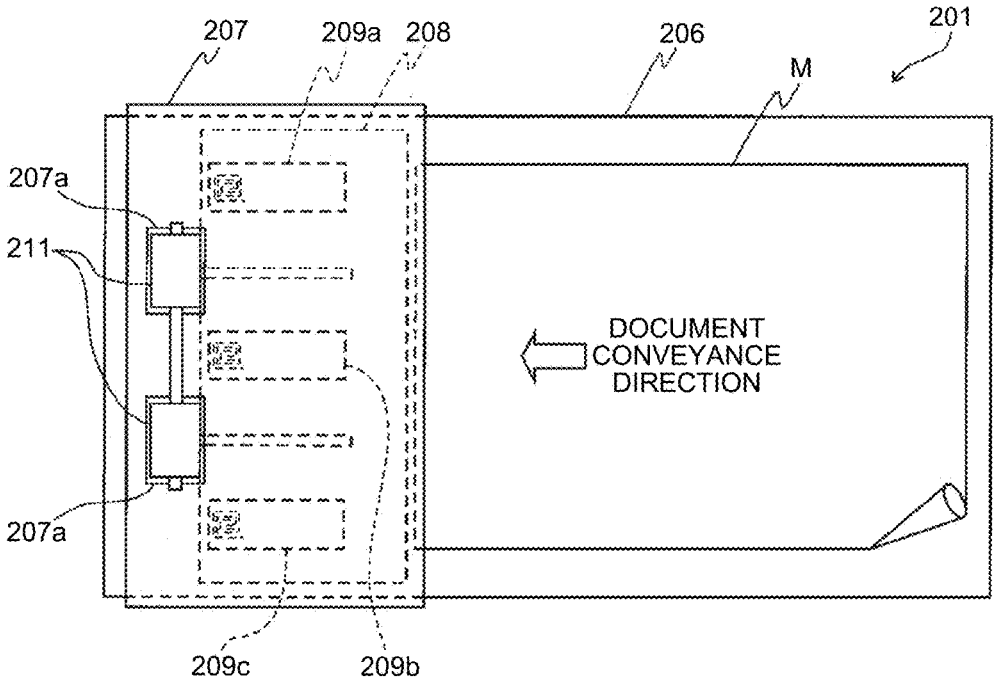
FIG. 21A is a plan view illustrating a paper feeding tray including a document placed on a first document conveyance guide plate of the auto document feeding device, as seen from above with a paper feed cover being opened.
Figure 21B:
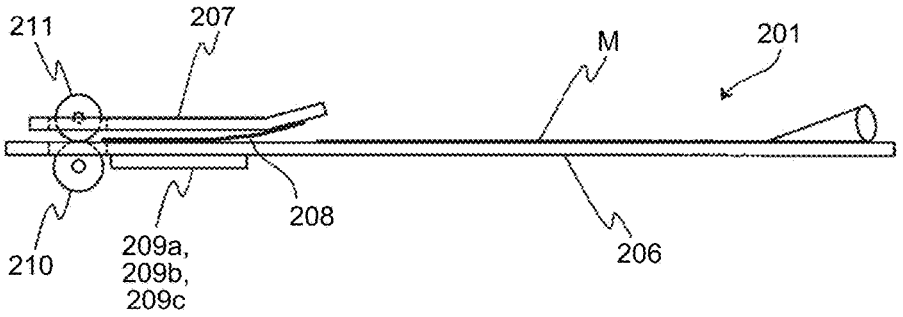
FIG. 21B is a side view of the paper feeding tray.
Figure 22:
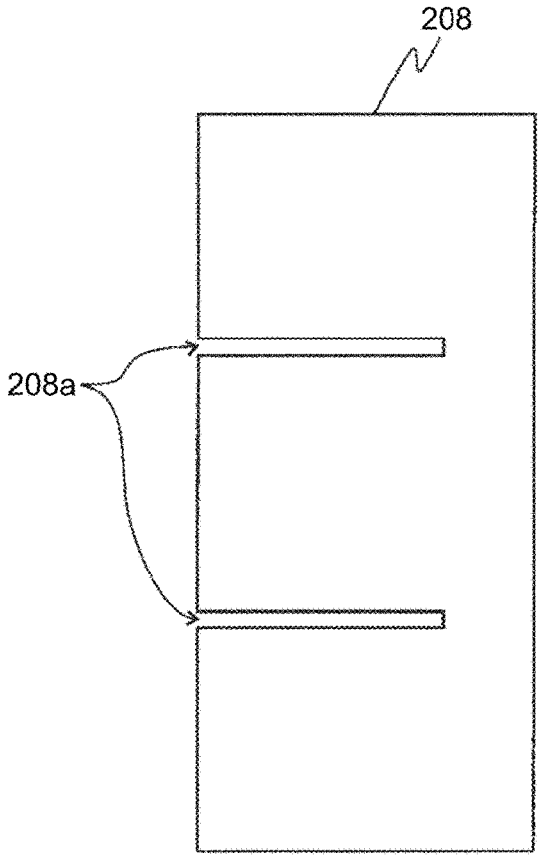
FIG. 22 is a plan view illustrating a document holding plate of the auto document feeding device.

FIG. 21A is a plan view illustrating the paper feeding tray 201 including the document M placed on the first document conveyance guide plate 206, as seen from above with the paper feed cover 213 being opened. FIG. 21B is a side view of the paper feeding tray 201. FIG. 22 is a plan view of the document holding plate 208. Note that FIGS. 21A and 21B illustrate a state in which the upper feed roller 211 normally stands by while being in contact with the lower feed roller 210 through an opening 207*a* of the second document conveyance guide plate 207 and an opening of the first document conveyance guide plate 206.

As illustrated in FIGS. 21A and 21B, a plurality of magnetic permeability sensors are disposed in a width direction perpendicular to the document conveyance direction at positions upstream of the lower feed roller 210 in the document conveyance direction on the rear side of the first document conveyance guide plate 206. In this example, three magnetic permeability sensors, specifically, a first magnetic permeability sensor 209*a*, a second magnetic permeability sensor 209*b*, and a third magnetic permeability sensor 209*c*, are disposed. The free end side of the document holding plate 208 placed on the second document conveyance guide plate 207 is provided at a position opposed to the first, second, and third magnetic permeability sensors 209*a*, 209*b*, and 209*c* via the first document conveyance guide plate 206. As illustrated in FIG. 22, the free end side of the document holding plate 208 is partitioned into a plurality of sections (partitioned into three in this example) in the width direction by two slits 208*a* so as to correspond to the plurality of sensors 209*a*, 209*b*, and 209*c*, respectively. The three partitioned free end portions of the document holding plate 208 can be displaced independently of one another. Regions near the centers of the three partitioned free end portions of the document holding plate 208 in the width direction perpendicular to the document conveyance direction are opposed to the first magnetic permeability sensor 209*a*, the second magnetic permeability sensor 209*b*, and the third magnetic permeability sensor 209*c*, respectively. Thus, if the thickness of the document M varies along the width direction, a displacement of at least one of the three partitioned free end portions of the document holding plate 208 differs from displacements of the others. As a result, at least one of the first, second, and third magnetic permeability sensors 209*a*, 209*b*, and 209*c* outputs an oscillation frequency different from oscillation frequencies of the others. Thus, the document detection controller with a function as a comparator can detect that the document M has portions with different thicknesses in the width direction. Therefore, documents bound together with a staple or clip, documents bound together in a staple-less manner, and a document with a folded edge or a curled front end can be detected at the stage when the document M is set between the first document conveyance guide plate 206 and the document holding plate 208, i.e., at the stage before conveying the document M for feeding.

In FIG. 21B, the document holding plate 208 is in contact with the first document conveyance guide plate 206. In such a state, the first, second, and third magnetic permeability sensors 209*a*, 209*b*, and 209*c* each output an initial oscillation frequency. The document detection controller stores the count value of the oscillation frequency in such an initial state for each 1 ms. Although the three first, second, and third magnetic permeability sensors 209*a*, 209*b*, and 209*c* have intrinsic individual variations in oscillation frequency, the oscillation frequency is generally about 3.725 MHz as illustrated in FIGS. 17 and 18 described above, for example. A counter in the document detection controller counts how many times the oscillation frequency alternates for 1 ms. As a result, a count value of about 3725 is obtained.

Figure 23A:
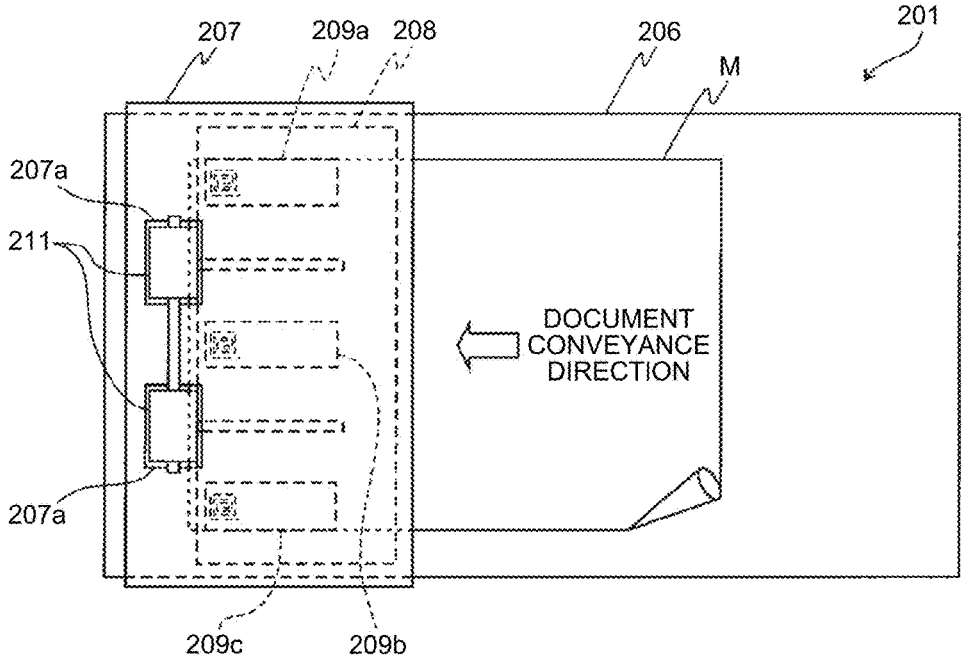
FIG. 23A is a plan view illustrating the paper feeding tray in a state in which the document has been moved from the state of FIG. 21A and set between the first document conveyance guide plate and the document holding plate.
Figure 23B:
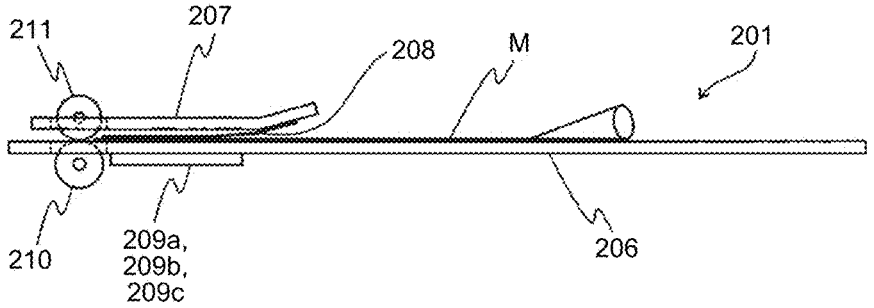
FIG. 23B is a side view of the paper feeding tray.

FIG. 23A is a plan view illustrating the paper feeding tray 201 including the document M set between the first document conveyance guide plate 206 and the document holding plate 208, as seen from above with the paper feed cover 213 being opened. FIG. 23B is a side view of such a paper feeding tray 201.

As illustrated in FIGS. 23A and 23B, when an operator moves the document M to a predetermined abutment position on the first document conveyance guide plate 206, the document setting sensor detects the document and outputs an ON signal. Concurrently, the document holding plate 208 moves away from the first, second, and third magnetic permeability sensors 209*a*, 209*b*, and 209*c* by an amount corresponding to the thickness of the document M. The increased gap between the document holding plate 208 and the first, second, and third magnetic permeability sensors 209*a*, 209*b*, and 209*c* causes the oscillation frequency outputted from each of the magnetic permeability sensors to lower. The oscillation frequency at this time is 3.695 MHz when the document M is thick paper with a thickness of 90 μm as illustrated in FIGS. 17 and 18 described above, for example.

After the elapse of a predetermined amount of time following the receiving of the ON signal from the document setting sensor, the document detection controller counts the oscillation frequencies of the first, second, and third magnetic permeability sensors 209*a*, 209*b*, and 209*c*. As mentioned above, the count initial value is about 3725, and the count value becomes 3695 when the document M, which is thick paper with a thickness of 90 μm, is set, for example. Here, the count value changes by 30 in each of the three first, second, and third magnetic permeability sensors 209*a*, 209*b*, and 209*c*. If the three first, second, and third magnetic permeability sensors 209*a*, 209*b*, and 209*c* all have an amount of change in the same range as just described, it is determined that the thicknesses of the three portions of the document M have no anomaly. In other words, it is determined that no foreign object, such as a staple, exists. The average of the count values at the three portions is then calculated to estimate the thickness of the document M on the basis of that value. The estimated thickness value of the document M can be reflected, as control information, in a fixing temperature or electrophotography process conditions in the color printer 100, for example. After the elapse of a predetermined amount of time or by an operation for starting document reading in the operating unit, the conveyance rollers such as the upper feed roller 211 and the lower feed roller 210 are rotary-driven to send the document M to the reading position of the slit glass 203 in the image reading device 202. Although the document setting sensor detects that the document M has been set at the predetermined abutment position on the first document conveyance guide plate 206, such detection can be performed on the basis of the fact that the count values of the first, second, and third magnetic permeability sensors 209*a*, 209*b*, and 209*c* have changed from their initial values by a predetermined amount.

Detection of the document M with the front end portion in the feeding conveyance direction being stapled will be described next.

Figure 24A:
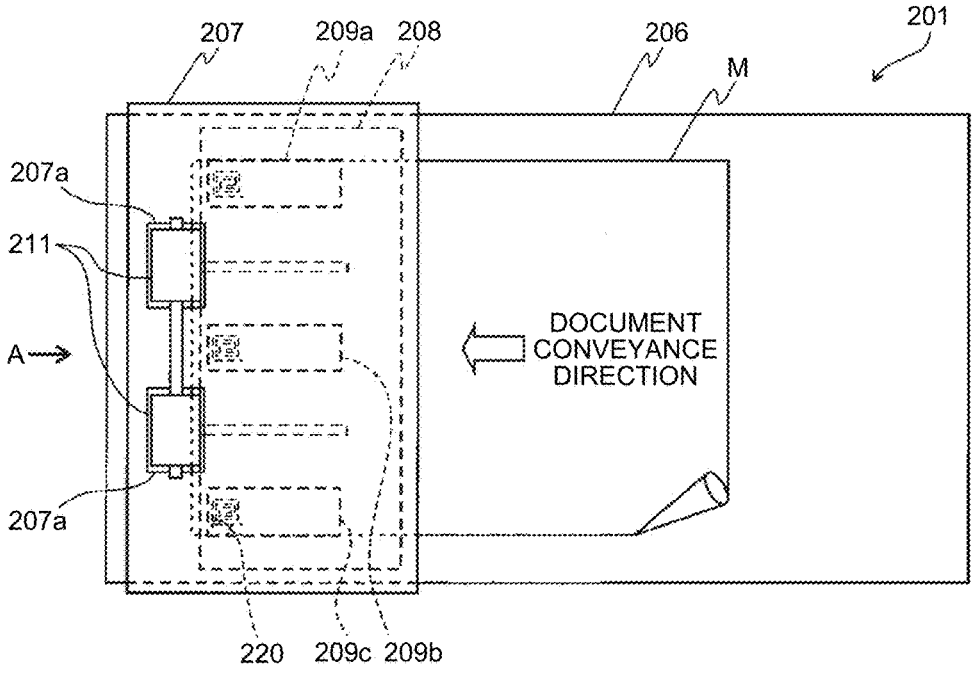
FIG. 24A is a plan view illustrating the paper feeding tray including a document having a staple as a foreign object, which is set between the first document conveyance guide plate and the document holding plate, as seen from above with the paper feed cover being opened.
Figure 24B:
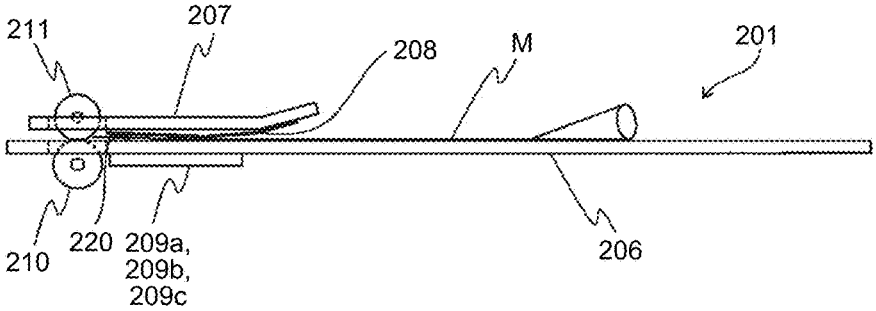
FIG. 24B is a side view of the paper feeding tray.
Figure 25:
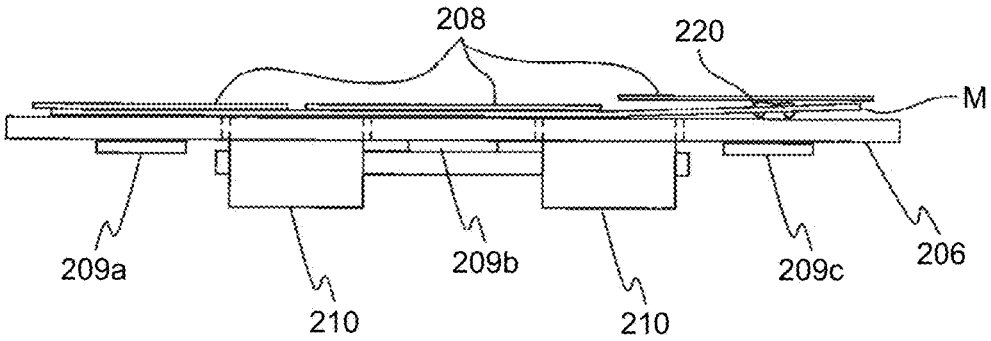
FIG. 25 is a front view of the paper feeding tray as seen in a direction of an arrow A in FIG. 24A.

FIG. 24A is a plan view illustrating the paper feeding tray 201 including the document M having a staple 220 as a foreign object, which is set between the first document conveyance guide plate 206 and the document holding plate 208, as seen from above with the paper feed cover 213 being opened. FIG. 24B is a side view of such a paper feeding tray 201. FIG. 25 is a front view of the paper feeding tray 201, which omits the illustration of the upper feed roller 211 and the second document conveyance guide plate 207, corresponding to a view as seen in a direction of an arrow A in FIG. 24A.

The document M stapled with the staple 220 at a left front end portion thereof in the document conveyance direction is set as illustrated in FIGS. 24A and 24B. A portion of the document holding plate 208 opposed to the staple 220 then lifts by an amount corresponding to the staple 220, thus increasing a gap between the document holding plate 208 and the third magnetic permeability sensor 209*c*. As a result, the oscillation frequency of the third magnetic permeability sensor 209*c* greatly lowers as compared to those of the first and second magnetic permeability sensors 209*a* and 209*b*, thus reducing the count value of the counter. When only one of the magnetic permeability sensors has a significant change in count value exceeding the range of normal variations as just described, it is determined that the document has an anomaly. When it is determined that an anomaly exists, error information may be transmitted to inform an operator that the document M has a foreign object such as the staple 220. Examples of a notifier may include display of error information on the operating panel or emission of a sound alarm. Also, the feeding conveyance of the document M by the upper feed roller 211 and the lower feed roller 210 is prohibited. This can prevent a damage to the document M from occurring. Moreover, not only the staple 220 but also a clip can be detected. Furthermore, without being limited to a metal foreign object such as the staple 220 or a clip, even staple-less bind performed by tucking down paper (paper stapler) can be detected since the paper thickness of the tucked-down portion increases. It is also possible to detect an anomaly such as the document M with a folded edge or a curled front end.

Figure 26:
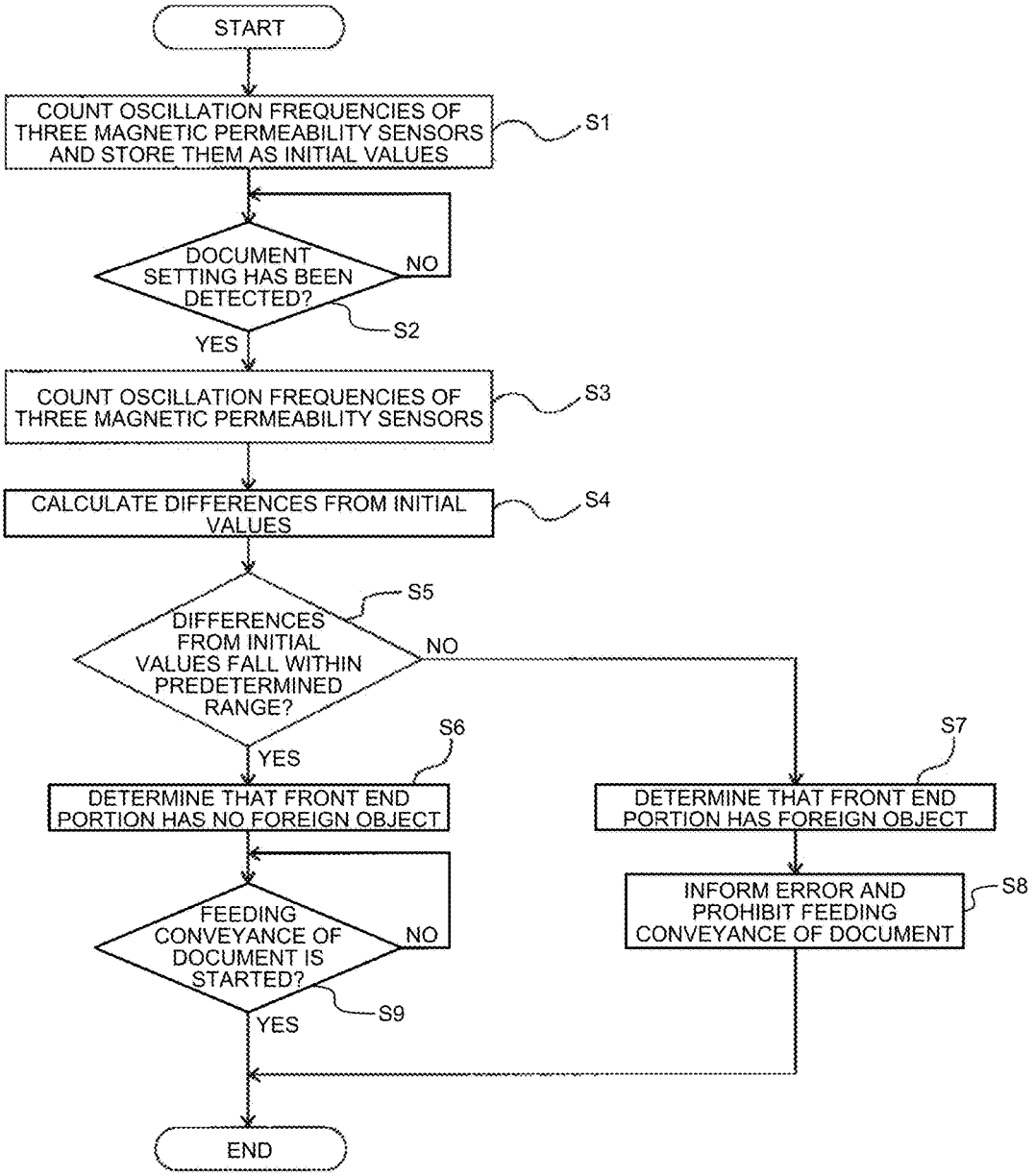
FIG. 26 is a flow chart for explaining an example of a procedure of detecting an anomaly of a document (detecting a foreign object) when the front end portion of the document is stapled with a staple, for example.

FIG. 26 is a flow chart for explaining an example of a procedure of detecting an anomaly of the document M (detecting a foreign object) when the front end portion of the document M is stapled with a staple, for example.

In FIG. 26, the document detection controller counts oscillation frequencies in the three first, second, and third magnetic permeability sensors 209*a*, 209*b*, and 209*c* when no document M is set on the first document conveyance guide plate 206 and stores the counted values as initial values (S1). The document detection controller then stands by until the document M is set at the predetermined abutment position on the first document conveyance guide plate 206 (No in S2).

If it is detected that the document M has been set at the predetermined abutment position on the first document conveyance guide plate 206 (Yes in S2), the oscillation frequencies of the three first, second, and third magnetic permeability sensors 209*a*, 209*b*, and 209*c* are counted after the elapse of a predetermined amount of time (e.g., after 0.5 seconds) (S3). A difference between the count value and the initial value is calculated for each of the three first, second, and third magnetic permeability sensors 209*a*, 209*b*, and 209*c* (S4). Thereafter, it is determined whether the calculated three differences fall within a predetermined range (S5). If the calculated three differences fall within the predetermined range (Yes in S5), it is determined that the front end portion of the document M in the conveyance direction has no foreign object such as a staple (S6). If the calculated three differences do not fall within the predetermined range, on the other hand, it is determined that the front end portion of the document M in the conveyance direction has a foreign object such as a staple (S7). After the error is informed and the feeding conveyance of the document M is prohibited (S8), the procedure is ended. This can prompt the operator to remove the foreign object and then restart the feeding conveyance of the document M.

When it is determined that the front end portion of the document M in the conveyance direction has no foreign object in S6 described above, the document M stands by until the feeding conveyance thereof is started in accordance with the input of an instruction for reading a document image from the operating panel, for example (No in S9). Once the instruction for reading the document image is inputted, the feeding conveyance of the document M is started (Yes in S9).

A portion of the document M having an anomaly, such as a portion having a foreign object such as the staple 220, a staple-less bound portion, or a folded edge portion, is not limited to the front end portion, side end portions, and the back end portion of the document M in the document conveyance direction. An anomaly existing anywhere in the document M can be detected. A single document M or a bundle of a plurality of documents may be subjected to feeding conveyance in the auto document feeding device 200.

The description as above is given by way of example only. Each of the following aspects has a particular effect.

Aspect A

A sheet material thickness detection device, such as the paper thickness detection device 40, for detecting a thickness of a sheet material, such as the paper P, being conveyed includes: a guide member, such as the driving roller-side conveyance guide plate 45, for guiding one side of the sheet material; a non-rotating pressing member, such as the paper pressing plate 44, for pressing the sheet material against the guide member in a manner displaceable in accordance with the thickness of the sheet material; a sensor, such as the magnetic permeability sensor 43, for magnetically or electrically detecting a displaced amount of the pressing member that is displaced in accordance with the thickness of the sheet material; and a calculator, such as the paper thickness detection controller 48, for calculating the thickness of the sheet material on the basis of an output signal of the sensor.

According to this aspect, when the pressing member is displaced in accordance with the thickness of the sheet material being conveyed via guiding by the guide member, the displaced amount of the pressing member can be magnetically or electrostatically detected by the sensor as described in the above-described embodiment. On the basis of the detection result about the displaced amount of the pressing member detected by this sensor, the thickness of the sheet material being conveyed can be calculated and detected.

The pressing member used for detecting the thickness of the sheet material has the non-rotating configuration. Thus, unlike using a detection roller with a conventional rotating configuration, the machining accuracy of the pressing member is less likely to affect the detection accuracy of the thickness of the sheet material. Thus, the thickness of the sheet material can be detected with high accuracy.

Moreover, there is no need to employ an expensive displacement roller having less machining error as in the use of the conventional displacement roller. Furthermore, there is no need to provide a complicated detection mechanism for mechanically detecting a displaced amount of a rotary shaft of the conventional displacement roller since a displaced amount of the pressing member that is displaced in accordance with a thickness of a sheet material can be magnetically or electrically detected with the sensor having a relatively simple configuration. Thus, reduction in cost can be achieved.

Aspect B

In Aspect A described above, the sensor includes: a coil that forms a magnetic circuit so as to pass through a space in which its magnetic permeability changes in accordance with a displacement of the pressing member against the guide member; and an oscillation circuit in which its oscillation frequency changes in accordance with an inductance of the coil. The sensor outputs a signal corresponding to the oscillation frequency of the oscillation circuit.

According to this aspect, the thickness of the sheet material is calculated on the basis of the oscillation frequency that changes in a manner highly sensitive to the displaced amount of the pressing member that is displaced in accordance with the thickness of the sheet material as described in the above-described embodiment. Thus, the resolution of the thickness detection of a sheet material can be improved.

Aspect C

In Aspect A or B described above, the sheet material thickness detection device includes: a rotary-driven driving rotor, such as the driving roller 41; and a driven rotor, such as the driven roller 42, arranged so as to sandwich the sheet material with the driving rotor.

According to this aspect, a sheet material to be subjected to thickness detection can be conveyed stably by sandwiching the sheet material between the driving rotor and the driven rotor as described in the above-described embodiment. Thus, the thickness of the sheet material can be detected with higher accuracy.

Aspect D

In Aspect C described above, a pressing position of the pressing member that is pressing the sheet material corresponds to a position same as a position at which the driving rotor and the driven rotor are opposed to each other or a position downstream of the opposed position in a sheet material conveyance direction.

According to this aspect, conveyance jam of a sheet material can be prevented from occurring as described in the above-described embodiment. Thus, the sheet material can be conveyed more stably and more reliably.

Aspect E

In any one of Aspects B to D described above, the sheet material thickness detection device includes: a plurality of driving rotors, such as the driving rollers 41, provided in a shaft direction of a driving shaft such as the driving roller shaft 41*a*; and a plurality of driven rotors, such as the driven rollers 42, arranged so that the sheet material is sandwiched between the plurality of driving rotors and the plurality of driven rotors. The sensor and the pressing member are arranged near the center in a width direction perpendicular to the sheet material conveyance direction between two of the driving rotors adjacent to each other.

According to this aspect, the thickness detection is less likely to be affected by the vibration of the driving rotors and the driven rotors as described in the above-described embodiment. Thus, the thickness of a sheet material can be detected with higher accuracy.

Aspect F

In any one of Aspects B to E described above, a natural frequency of the pressing member and a periodic fluctuation frequency resulting from an eccentric amount and a rotating speed of the driving rotor differ from each other.

According to this aspect, the vibration of the pressing member resonating with the vibration of the driving rotor can be prevented from occurring as described in the above-described embodiment. Thus, degradation in the detection accuracy of a thickness of a sheet material due to the vibration of the driving rotor can be prevented.

Aspect G

In any one of Aspects B to F described above, the sheet material thickness detection device includes a guide member on the driving rotor side, such as the driving roller-side conveyance guide plate 45, and a guide member on the driven rotor side, such as the driven roller-side conveyance guide plate 46, provided to form a conveyance path of a sheet material so that the conveyance path passes through the opposed position between the driving rotor and the driven rotor. The sensor is fixed to a surface of the guide member on the driving rotor side opposite to the conveyance path, and the pressing member is provided on a surface of the guide member on the driven rotor side closer to the conveyance path.

According to this aspect, an interference between a sheet material being conveyed through the conveyance path and the sensor can be prevented from occurring, and the sheet material can be reliably pressed against the guide member on the driving rotor side as described in the above-described embodiment.

Aspect H

In any one of Aspects A to G described above, the pressing member is a metal plate having non-magnetic conductivity.

According to this aspect, a displacement of the pressing member in accordance with a thickness of a sheet material is less likely to be affected by a magnetic field therearound as described in the above-described embodiment. Thus, degradation in the detection accuracy of the thickness of the sheet material due to the influence of the magnetic field therearound can be prevented.

Aspect I

In any one of Aspects A to G described above, the pressing member is a metal plate having magnetic conductivity.

According to this aspect, a degree of change in magnetic permeability of the magnetic circuit with respect to a displacement of the pressing member can be increased as described in the above-described embodiment. Thus, the thickness of a sheet material can be detected with higher accuracy.

Aspect J

In any one of Aspects A to I described above, the pressing member is made of an elastically-deformable material, and the pressing member presses the sheet material against the guide member within a range of elastic deformation.

According to this aspect, when mechanical noise from an area around the pressing member exists, such noise can be absorbed by the elasticity of the pressing member, and thus the pressing member can reliably press the sheet material as described in the above-described embodiment. Therefore, degradation in the detection accuracy of the thickness of the sheet material due to the mechanical noise from the area around the pressing member can be prevented.

Aspect K

In any one of Aspects A to J described above, a plurality of the sensors, such as the first, second, and third magnetic permeability sensors 209*a*, 209*b*, and 209*c*, are provided in the width direction perpendicular to the sheet material conveyance direction; the pressing member is partitioned into a plurality of sections in the width direction so as to correspond to the plurality of the sensors, respectively; and the sheet material thickness detection device includes a comparator, such as the document detection controller, for comparing values corresponding to thicknesses of a plurality of portions in the sheet material, such as the document M, corresponding to the plurality of the sensors with one another on the basis of output signals from the plurality of the sensors.

According to this aspect, whether any one of the thicknesses in the plurality of portions is greater than the values in the other portions can be detected by comparing the values corresponding to the thicknesses of the plurality of portions in the sheet material such as the document M with one another as described in the above-described embodiment. By detecting that part of the sheet material has a larger thickness, an anomaly about the thickness of the sheet material, e.g., a foreign object such as a staple or clip, staple-less bind, a folded edge, or a curled front end, which is a cause of the partially-increased thickness, can be detected.

According to Aspect K, in particular, the plurality of sections of the pressing member partitioned in the width direction can be displaced independently of one another in accordance with the thicknesses of the plurality of portions in the sheet material. Thus, the accuracy of the values corresponding to the thicknesses of the plurality of portions can be improved.

Aspect L

In Aspect K described above, three such sensors are provided so as to correspond to three portions of the sheet material at both ends and a center in the width direction, and the pressing member is partitioned into three in the width direction so as to correspond to the respective three sensors.

According to this aspect, the sensors are provided so as to correspond to the three portions including the both ends of the sheet material in the width direction at which a partial thickness anomaly is more likely to occur, and the pressing member is partitioned into three so as to correspond to such three sensors as described in the above-described embodiment. Thus, the partial thickness anomaly of the sheet material can be detected more reliably.

Aspect M

A sheet material anomaly detection device for detecting an anomaly of a sheet material, such as the document M, being conveyed includes: a plurality of sensors, such as the first, second, and third magnetic permeability sensors 209*a*, 209*b*, and 209*c*, provided in a width direction perpendicular to a sheet material conveyance direction that can each output a signal corresponding to a thickness of the sheet material; and a comparator, such as the document detection controller, for comparing values corresponding to thicknesses of a plurality of portions in the sheet material corresponding to the plurality of sensors with one another on the basis of output signals from the plurality of sensors.

According to this aspect, whether any one of the thicknesses in the plurality of portions is greater than the values in the other portions can be detected by comparing the values corresponding to the thicknesses of the plurality of portions in the sheet material such as the document M with one another as described in the above-described embodiment. By detecting that part of the sheet material has a larger thickness, an anomaly about the thickness of the sheet material, e.g., a foreign object such as a staple or clip, staple-less bind, a folded edge, or a curled front end, which is a cause of the partially-increased thickness, can be detected.

Aspect N

In Aspect M described above, the sheet material anomaly detection device includes: a guide member, such as the driving roller-side conveyance guide plate 45, for guiding one side of the sheet material such as the document M; and a non-rotating pressing member, such as the paper pressing plate 44, for pressing the sheet material against the guide member in a manner displaceable in accordance with a thickness of the sheet material. The sensor magnetically or electrically detects a displaced amount of the pressing member that is displaced in accordance with the thickness of the sheet material.

According to this aspect, when the pressing member is displaced in accordance with the thickness of the sheet material being conveyed via guiding by the guide member, the displaced amount of the pressing member can be magnetically or electrostatically detected by the sensor as described in the above-described embodiment. On the basis of the detection result about the displaced amount of the pressing member detected by this sensor, the partial thickness of the sheet material being conveyed can be detected.

The pressing member used for detecting the thickness of the sheet material has the non-rotating configuration. Thus, unlike using a detection roller with a conventional rotating configuration, the machining accuracy of the pressing member is less likely to affect the detection accuracy of the thickness of the sheet material. Thus, the partial thickness of the sheet material can be detected with high accuracy.

Moreover, there is no need to employ an expensive displacement roller having less machining error as in the conventional displacement roller. Furthermore, there is no need to provide a complicated detection mechanism for mechanically detecting a displaced amount of a rotary shaft of the conventional displacement roller since a displaced amount of the pressing member that is displaced in accordance with a thickness of a sheet material can be magnetically or electrically detected with the sensor having a relatively simple configuration. Thus, reduction in cost can be achieved.

Aspect O

In Aspect N described above, the sensor includes: a coil that forms a magnetic circuit so as to pass through a space in which its magnetic permeability changes in accordance with a displacement of the pressing member against the guide member; and an oscillation circuit in which its oscillation frequency changes in accordance with an inductance of the coil. The sensor outputs a signal corresponding to the oscillation frequency of the oscillation circuit.

According to this aspect, the resolution of the detection of the partial thickness of a sheet material can be improved on the basis of the oscillation frequency that changes in a manner highly sensitive to the displaced amount of the pressing member that is displaced in accordance with the thickness of the sheet material as described in the above-described embodiment.

Aspect P

In Aspect N or O described above, the pressing member is partitioned into a plurality of sections in the width direction so as to correspond to the plurality of sensors.

According to this aspect, the plurality of sections of the pressing member partitioned in the width direction can be displaced independently of one another in accordance with the thicknesses of the plurality of portions in the sheet material as described in the above-described embodiment. Thus, the accuracy of the values corresponding to the thicknesses of the plurality of portions can be improved.

Aspect Q

In Aspect P described above, three such sensors are provided so as to correspond to three portions of the sheet material at both ends and a center in the width direction, and the pressing member is partitioned into three in the width direction so as to correspond to the respective three sensors.

According to this aspect, the sensors are provided so as to correspond to the three portions including the both ends of the sheet material in the width direction at which a partial thickness anomaly is more likely to occur, and the pressing member is partitioned into three so as to correspond to such three sensors as described in the above-described embodiment. Thus, the partial thickness anomaly of the sheet material can be detected more reliably.

Aspect R

A sheet material feeding device, such as the paper feeding device or the auto document feeding device 200, includes the sheet material thickness detection device according to any one of Aspects A to L described above or the sheet material anomaly detection device according to any one of Aspects M to Q described above.

According to this aspect, the thickness of a sheet material such as the paper P or the document M to be fed can be detected with high accuracy and reduction in cost can be achieved as described in the above-described embodiment. In particular, a partial thickness anomaly of a sheet material, such as the document M, due to a foreign object such as a staple or clip, staple-less bind, a folded edge, or a curled front end can be detected before starting the feeding conveyance of the sheet material. Thus, the feeding conveyance of the sheet material having such a partial thickness anomaly can be prevented, and thus a damage to the sheet material can be prevented from occurring.

Aspect S

An image forming device, such as the printer 100, includes: the sheet material thickness detection device, such as the paper thickness detection device 40, according to any one of Aspects A to L described above or the sheet material anomaly detection device according to any one of Aspects M to Q described above; and an image forming unit, such as the image forming units 10Y, 10C, 10M, and 10K, for forming an image on the sheet material such as the paper P.

According to this aspect, the thickness of a sheet material before image formation or the thickness of the sheet material after the image formation can be detected with high accuracy and reduction in cost can be achieved as described in the above-described embodiment. Furthermore, the feeding conveyance of a sheet material having a partial thickness anomaly can be prevented, and thus a damage to the sheet material can be prevented from occurring.

Aspect T

An image forming device includes: a first sheet feeder, such as the paper feeding device, for feeding a first sheet material, such as the paper P, to be subjected to image formation; a second sheet feeder, such as the auto document feeding device 200, for feeding a second sheet material, such as the document M, including an image to be formed; an image reader, such as the image reading device 202, for reading the image of the second sheet material fed by the second sheet feeder; and an image forming unit, such as the printer 100, for forming an image on the first sheet material on the basis of the image read by the image reader. The image forming device employs the sheet material feeding device according to Aspect R described above as the second sheet feeder.

According to this aspect, the thickness of the second sheet material, such as the document M, to be subjected to image reading can be detected with high accuracy, and reduction in cost can be achieved as described in the above-described embodiment. Furthermore, a partial thickness anomaly of the second sheet material, such as the document M, due to a foreign object such as a staple or clip, staple-less bind, a folded edge, or a curled front end can be detected before starting the feeding conveyance of the second sheet material. Thus, the feeding conveyance of the second sheet material having such a partial thickness anomaly can be prevented, and thus a damage to the second sheet material can be prevented from occurring.

According to the present invention, the thickness of a sheet material can be detected with high accuracy and reduction in cost can be achieved.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

Any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A sheet material thickness detection device comprising:

a guide member to guide one side of a sheet material being conveyed;

a non-rotating pressing member to press the sheet material against the guide member in a manner displaceable in accordance with a thickness of the sheet material;

a magnetic or electric sensor configured to magnetically or electrically detect a displaced amount of the non-rotating pressing member, displaced in accordance with the thickness of the sheet material; and at least one processor configured to calculate the thickness of the sheet material based on an output signal of the magnetic or electric sensor, wherein the magnetic or electric sensor includes a coil to form a magnetic circuit so as to pass through a space in which magnetic permeability of the coil changes in accordance with a displacement of the non-rotating pressing member against the guide member, and an oscillation circuit, wherein an oscillation frequency of the oscillation circuit changes in accordance with an inductance of the coil, the magnetic or electric sensor being configured to output a signal corresponding to the oscillation frequency of the oscillation circuit.

2. The sheet material thickness detection device according to claim 1, further comprising:

a driving rotor; and a driven rotor arranged so as to sandwich the sheet material with the driving rotor.

3. The sheet material thickness detection device according to claim 1, further comprising:

a plurality of driving rotors provided in a shaft direction of a driving shaft; and a plurality of driven rotors arranged so that the sheet material is sandwiched between the plurality of driving rotors and the plurality of driven rotors, wherein the magnetic or electric sensor and the non-rotating pressing member are arranged near a center in a width direction perpendicular to the sheet material conveyance direction between two of the plurality of driving rotors that are adjacent to each other.

4. The sheet material thickness detection device according to claim 1, wherein the magnetic or electric sensor includes a plurality of sensors and wherein the plurality of the sensors are provided in a width direction perpendicular to a sheet material conveyance direction, the non-rotating pressing member is partitioned into a plurality of sections in the width direction so as to correspond to the plurality of the sensors, respectively, and the sheet material thickness detection device further comprises a comparator configured to compare values corresponding to thicknesses of a plurality of portions in the sheet material corresponding to the plurality of sensors with one another based on output signals from the plurality of the sensors.

5. The sheet material thickness detection device according to claim 4, wherein the plurality of sensors includes three sensors provided so as to correspond to three portions of the sheet material at both ends and a center in the width direction, and the non-rotating pressing member is partitioned into three in the width direction so as to correspond to the three sensors.

6. A sheet material feeding device comprising the sheet material thickness detection device according to claim 1.

7. An image forming device comprising:

a first sheet feeder configured to feed a first sheet material to be subjected to image formation;

a second sheet feeder configured to feed a second sheet material including an image to be formed;

an image reader configured to read the image of the second sheet material fed by the second sheet feeder; and an imaging device configured to form an image on the first sheet material based on the image read by the image reader, wherein the second sheet feeder is the sheet material feeding device according to claim 6.

8. An image forming device comprising:

the sheet material thickness detection device according to claim 1; and an imaging device configured to form an image on the sheet material.

9. The sheet material thickness detection device according to claim 1, wherein the magnetic or electric sensor is a magnetic permeability sensor.

10. The sheet material thickness detection device according to claim 1, wherein the magnetic or electric sensor includes a Colpitts LC oscillator.

11. A sheet material thickness detection device comprising:

a guide member to guide one side of a sheet material being conveyed;

a non-rotating pressing member to press the sheet material against the guide member in a manner displaceable in accordance with a thickness of the sheet material;

a magnetic or electric sensor configured to magnetically or electrically detect a displaced amount of the non-rotating pressing member, displaced in accordance with the thickness of the sheet material;

at least one processor configured to calculate the thickness of the sheet material based on an output signal of the magnetic or electric sensor;

a driving rotor; and a driven rotor arranged so as to sandwich the sheet material with the driving rotor, wherein a pressing position of the non-rotating pressing member that is pressing the sheet material corresponds to a position at which the driving rotor and the rotary-driven driven rotor are opposed to each other or a position downstream of the opposed position in a conveyance direction of the sheet material.

12. The sheet material thickness detection device according to claim 11, wherein the magnetic or electric sensor includes a coil to form a magnetic circuit so as to pass through a space in which magnetic permeability of the coil changes in accordance with a displacement of the non-rotating pressing member against the guide member, and an oscillation circuit, wherein an oscillation frequency of the oscillation circuit changes in accordance with an inductance of the coil, the magnetic or electric sensor being configured to output a signal corresponding to the oscillation frequency of the oscillation circuit.

13. The sheet material thickness detection device according to claim 12, further comprising:

a plurality of driving rotors provided in a shaft direction of a driving shaft; and a plurality of driven rotors arranged so that the sheet material is sandwiched between the plurality of driving rotors and the plurality of driven rotors, wherein the magnetic or electric sensor and the non-rotating pressing member are arranged near a center in a width direction perpendicular to the sheet material conveyance direction between two of the plurality of driving rotors that are adjacent to each other.

14. A sheet material feeding device comprising the sheet material thickness detection device according to claim 11.

15. An image forming device comprising:

a first sheet feeder configured to feed a first sheet material to be subjected to image formation;

a second sheet feeder configured to feed a second sheet material including an image to be formed;

an image reader configured to read the image of the second sheet material fed by the second sheet feeder; and an imaging device configured to form an image on the first sheet material based on the image read by the image reader, wherein the second sheet feeder is the sheet material feeding device according to claim 14.

16. An image forming device comprising:

the sheet material thickness detection device according to claim 11; and an imaging device configured to form an image on the sheet material.

17. The sheet material thickness detection device according to claim 11, wherein the magnetic or electric sensor is a magnetic permeability sensor.

18. The sheet material thickness detection device according to claim 11, wherein the magnetic or electric sensor includes a Colpitts LC oscillator.

19. A sheet material thickness detection device, comprising:

a guide member to guide one side of a sheet material being conveyed;

a non-rotating pressing member to press the sheet material against the guide member in a manner displaceable in accordance with a thickness of the sheet material;

a magnetic or electric sensor configured to magnetically or electrically detect a displaced amount of the non-rotating pressing member, displaced in accordance with the thickness of the sheet material; and at least one processor configured to calculate the thickness of the sheet material based on an output signal of the magnetic or electric sensor;

a driving rotor; and a driven rotor arranged so as to sandwich the sheet material with the driving rotor, wherein the driving rotor including a plurality of driving rotors and the driven rotor includes a plurality of driven rotors and wherein:

the plurality of driving rotors are provided in a shaft direction of a driving shaft; and the plurality of driven rotors are arranged so that the sheet material is sandwiched between the plurality of driving rotors and the plurality of driven rotors, and wherein the magnetic or electric sensor and the non-rotating pressing member are arranged near a center in a width direction perpendicular to the sheet material conveyance direction between two of the plurality of driving rotors that are adjacent to each other.

* * * * *